US010415351B2

(12) United States Patent
Lange et al.

(10) Patent No.: US 10,415,351 B2
(45) Date of Patent: Sep. 17, 2019

(54) SEPARATING DEVICE FOR REMOVING SOLID PARTICLES FROM LIQUID AND GAS FLOWS FOR HIGH DIFFERENTIAL PRESSURES

(71) Applicant: 3M INNOVATIVE PROPERTIES COMPANY, St. Paul, MN (US)

(72) Inventors: Dietrich Lange, Weitnau (DE); Christoph Lesniak, Buchenberg (DE); Alexander Krecker, Kempten (DE)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 224 days.

(21) Appl. No.: 15/329,983

(22) PCT Filed: Jul. 27, 2015

(86) PCT No.: PCT/US2015/042288
§ 371 (c)(1),
(2) Date: Jan. 27, 2017

(87) PCT Pub. No.: WO2016/018821
PCT Pub. Date: Feb. 4, 2016

(65) Prior Publication Data

US 2017/0254185 A1 Sep. 7, 2017

(30) Foreign Application Priority Data

Jul. 30, 2014 (EP) ..... 14179128

(51) Int. Cl.
*E21B 43/08* (2006.01)

(52) U.S. Cl.
CPC ..... *E21B 43/086* (2013.01)

(58) Field of Classification Search
CPC ..... E21B 43/08; E21B 43/088; E21B 43/086; B01D 29/46; B01D 39/2068; B01D 46/406
(Continued)

(56) References Cited

U.S. PATENT DOCUMENTS 1,570,725 A * 1/1926 Benckenstein ..... E21B 43/086 166/235
1,705,848 A * 3/1929 Austin ..... E21B 43/088 166/235
(Continued)

FOREIGN PATENT DOCUMENTS

CA 2761802 A1 * 11/2010 ..... E21B 3/086
CA 2858242 A1 * 6/2013 ..... E21B 7/20
(Continued)

OTHER PUBLICATIONS

International Search Report for PCT International Application No. PCT/US2015/042288, dated Nov. 27, 2015, 5 pages.

*Primary Examiner* — Jennifer H Gay
(74) *Attorney, Agent, or Firm* — Thomas M. Spielbauer

(57) ABSTRACT

The subject matter of the invention is a separating device for removing solid particles from liquids and/or gases in extraction wells, comprising a) an annular stack (7) of at least three brittle-hard annular discs (8), the upper side (9) of the annular discs (8) having at least three spacers (10), which are distributed uniformly over the circular circumference of the discs and the contact area (11) of which is planar, so that the spacers (10) have planiform contact with the underside of an adjacent annular disc (8), and the annular discs (8) being stacked and fixed in such a way that between the individual discs (8) there is in each case a separating gap (14) for the removal of solid particles, and the axial projection of the annular discs (8) at the inner and the outer circumference
(Continued)

being circular, and the brittle-hard material of the annular discs (8) being chosen from oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ and long- and/or short-fiber-reinforced ceramic materials, b) a perforated pipe (1), which is located inside the annular stack (7) and on which the brittle-hard annular discs (8) are stacked, c) at least three bands (15), which are provided axially parallel and uniformly spaced apart on the lateral surface (21) of the perforated pipe (1) located inside the annular stack (7) and onto which the annular discs (8) have been pushed, whereby the annular discs (8) are centered on the perforated pipe (1), and d) an end cap (5) at the upper end and an end cap (6) at the lower end of the annular stack (7), the end caps (5, 6) being firmly connected to the perforated pipe (1). The subject matter of the invention is likewise the use of a separating device according to the invention for removing solid particles from liquids and/or gases in a process for extracting liquids and/or gases from extraction wells.

18 Claims, 26 Drawing Sheets

(58) Field of Classification Search
USPC ..... 166/235
See application file for complete search history.

(56) References Cited

U.S. PATENT DOCUMENTS 1,976,217 A * 10/1934 Diepenbrock ..... E21B 43/088 166/235
2,004,071 A * 6/1935 Hannesschlager ..... B01D 29/15 166/235
2,185,999 A * 1/1940 Johnson ..... E21B 43/088 228/182
2,250,871 A * 7/1941 Lumbert ..... E21B 43/086 166/235
2,281,326 A * 4/1942 Records ..... E21B 43/088 166/234
2,746,552 A * 5/1956 Grospas ..... B01D 29/46 166/235
3,009,519 A * 11/1961 Brown ..... E21B 43/088 166/235
3,822,744 A * 7/1974 Reijonen ..... E03B 3/20 166/235
4,752,394 A * 6/1988 McKenzie ..... B01D 29/46 166/235
5,122,271 A * 6/1992 Simon ..... B01D 29/15 210/314
5,249,626 A * 10/1993 Gibbins ..... B01D 29/33 166/235
D365,139 S * 12/1995 Gibbins ..... B01D 29/33 D23/209
8,196,653 B2 * 6/2012 Fripp ..... E21B 34/08 166/205
8,662,167 B2 * 3/2014 Wildhack ..... E21B 43/088 166/230
8,833,447 B2 * 9/2014 Mussig ..... B01D 29/46 166/230
8,893,781 B2 * 11/2014 Kayser ..... E21B 43/086 166/227
2004/0020832 A1 * 2/2004 Richards ..... E21B 34/06 210/106
2010/0252250 A1 * 10/2010 Fripp ..... E21B 34/08 166/66
2011/0220347 A1 * 9/2011 Kayser ..... E21B 43/086 166/235
2012/0018146 A1 * 1/2012 Wildhack ..... E21B 43/086 166/244.1
2012/0024520 A1 * 2/2012 Fripp ..... E21B 34/08 166/66
2012/0125601 A1 * 5/2012 Mussig ..... B01D 29/46 166/235
2016/0273320 A1 * 9/2016 Greci ..... E21B 43/088
2017/0211361 A1 * 7/2017 Reid ..... E21B 43/08
2017/0254185 A1 * 9/2017 Lange ..... E21B 43/086
2018/0320486 A1 * 11/2018 Reid ..... E21B 43/08

FOREIGN PATENT DOCUMENTS

CN 2057210 U 5/1990
CN 2249822 Y 3/1997
CN 2276073 Y 3/1998
CN 2729307 Y 9/2005
DE 3913986 A1 11/1989
DE 102008057894 6/2010
RU 2453682 C1 6/2012
SU 981592 A1 12/1982
WO WO 2011-009469 1/2011
WO WO 2011-120539 10/2011
WO WO 2013-137781 A2 9/2013

* cited by examiner

SEPARATING DEVICE FOR REMOVING SOLID PARTICLES FROM LIQUID AND GAS FLOWS FOR HIGH DIFFERENTIAL PRESSURES

CROSS REFERENCE TO RELATED APPLICATIONS

This application is a national stage filing under 35 U.S.C. 371 of PCT/US2015/042288, filed Jul. 27, 2015, which claims the benefit of European Application No. 14179128.5, filed Jul. 30, 2014, the disclosure of which is incorporated by reference in their entirety herein.

TECHNICAL FIELD

The present invention relates to a novel separating device for high differential pressures, with which undesired solid particles can be separated from a volumetric flow of oil, gas and water or mixtures thereof.

BACKGROUND

Such separating devices are required in many oil and gas extraction wells. Mineral oil and natural gas are stored in naturally occurring underground reservoirs, the oil or gas being distributed in more or less porous and permeable mineral layers. The aim of every oil or gas drill hole is to reach the reservoir and exploit it in such a way that, as far as possible, only saleable products such as oil and gas are extracted, while undesired byproducts are minimized or even avoided completely. The undesired byproducts in oil and gas extraction include solid particles such as sands and other mineral particles that are entrained from the reservoir up to the borehole by the liquid or gas flow. Depending on the permeability of the geological layer and the formation pressure, the flow rates of the solids-laden liquid and gas flow can become very high, up to 15 m/sec, and in individual cases even higher.

Since the mineral sands are often abrasive, the influx of such solids into the production tubing and pump cause considerable undesired abrasive and erosive wear on all of the technical internals of the borehole. It is therefore endeavoured to free the production flow of undesired sands directly after it leaves the reservoir, that is to say while it is still in the borehole, by filter systems.

Problems of abrasion and erosion in the removal of solid particles from liquid and gas flows are not confined to the oil and gas industry, but may also occur in the extraction of water. Water may be extracted for the purpose of obtaining drinking water or else for the obtainment of geothermal energy. The porous, often loosely layered reservoirs of water have the tendency to introduce a considerable amount of abrasive particles into the material that is extracted. In these applications too, there is the need for abrasion- and erosion-resistant filters.

In oil and gas extraction, the separation of undesired particles is usually achieved today by using filters that are produced by spirally winding and welding steel forming wires onto a perforated basepipe. Such filters are referred to as "wire wrap filters". Another commonly used type of construction for filters in oil and gas extraction is that of wrapping a perforated basepipe with steel screening meshes. These filters are referred to as "metal mesh screens". Both methods provide filters with effective screen apertures of 75 μm to 350 μm. Depending on the type of construction and the planned intended use of both these types of filter, the filtering elements are additionally protected from mechanical damage during transport and introduction into the borehole by an externally fitted, coarse-mesh cage. The disadvantage of these types of filter is that, under the effect of the abrasive particles flowing at high speed, steel structures are subject to rapid abrasive wear, which quickly leads to destruction of the filigree screen structures. Such high-speed abrasive flows often occur in oil and/or gas extraction wells, which leads to considerable technical and financial maintenance expenditure involved in changing the filters. There are even extraction wells which, for reasons of these flows, cannot be controlled by the conventional filtering technique, and therefore cannot be commercially exploited. Conventional metallic filters are subject to abrasive and erosive wear, since steels, even if they are hardened, are softer than the particles in the extraction wells, which sometimes contain quartz.

There is therefore a great need to counter the abrasive flows of sand with abrasion-resistant screen structures.

DE 10 2008 057 894 A1, WO2011/009469 A1 and WO2011/120539 A1 propose filter structures in which the filter gaps, that is to say the functional openings of the filter, are created by stacking specially formed densely sintered annular discs of a brittle-hard material, preferably of a ceramic material. In this case, at least three spacers are arranged on the upper side of annular discs, distributed uniformly over the circular circumference of the discs, and the discs are stacked one on top of the other in such a way that the spacers respectively lie one over the other.

The spacers are in the form of spherical segments. However, forming the spacers as spherical segments has the disadvantage that the ceramic materials that have very good resistance to abrasion and erosion, such as densely sintered silicon carbide, are sensitive to point pressure loading and, when subjected to excessive stress as a result of the point pressure loading, fail due to rupturing. High point contact loads are referred to as Hertzian stress. In the volume of material underneath the point that is under compressive load, high tensile stresses occur as a result of the point pressure loading and can lead to rupturing of the ceramic rings.

In the normal operating state, the separating device only experiences insignificant differences in pressure between the inlet side and the outlet side of the filter. This is the case as long as the separating device is not plugged, i.e. clogged, and can be flowed through more or less freely. The differences in pressure or pressure losses in the separating device are low under normal operating conditions. If, however, the filter gaps are plugged, the differences in pressure can increase very sharply.

One reason for the plugging or clogging of the separating device may be undesired lodgement of mineral particles at the inlet opening of the filter, that is to say at the annular gaps on the outer circumference of the annular stack. Among the factors on which the risk of plugging depends are the particle size distribution of the mineral particles/liquid mixture and the flow rate at the location of the filter.

Another reason for the plugging or clogging of the separating device may be that the borehole is intentionally filled with highly viscous liquids laden with solids. Such a liquid is referred to as a "fluid loss control pill".

Then, depending on the operating conditions in the borehole, the plugged or clogged filter may be exposed to very great differences in pressure, which are of the order of magnitude of 2500 psi (corresponding to 172 bar or 17.2 MPa) external pressure, that is to say exposure to pressure from the outside, and 1000 psi (corresponding to 69 bar or 6.9 MPa) internal pressure, that is to say exposure to pressure from the inside.

External pressure loading occurs for example when the filter becomes plugged by undesired lodgement of mineral particles at the inlet opening of the filter, internal pressure loading occurring for example when the plugged filter is cleaned by flushing.

The users of filters therefore have a justified interest in taking the pressure resistance of filters into account in the design, and measuring it by a standard method.

These circumstances gave rise to the development of the measuring standard ISO 17824, First Edition, 2009 Aug. 15, for determining the pressure resistance of such filters. The filter is in this case subjected to internal pressure (burst pressure test) or external pressure (collapse pressure test) by using a viscous liquid laden with solids in tWOtest setups. In these tests, the pressure is increased until, as a result of the effect of the pressure, the filter allows coarser particles than correspond to the filter width to pass through, which is evident from a drop in pressure in the filter or in the feed line of the measuring fluid. This event is also referred to by the technical term "loss of sand control", LSC for short.

The structural design of the filters according to DE 10 2008 057 894 A1, WO2011/009469 A1 and WO2011/120539 A1 has the effect that, in the tests according to ISO 17824, when the pressure builds up local pressure breakthroughs occur in portions of individual filter gap openings. These pressure breakthroughs can be explained by the bridge-forming solid particles of the measuring fluid being forced through the filter gap as a result of a too high pressure, which in turn causes an increase in pressure in the filter gap. The bridges formed by the solid particles collapse under the loading of the pressure. The liquid pressure then prevailing temporarily in the filter gap causes great axial forces, which put an axial load on the annular disc segments lying on both sides of the breached filter gap and also great flexural stress, so that there is the risk of the rings rupturing.

When testing the filters proposed in DE 10 2008 057 894 A1, WO2011/009469 A1 and WO2011/120539 A1 for their internal and external pressure resistance (burst pressure test, collapse pressure test) according to ISO 17824 and also when using them in production, there may be pressure conditions that lead to very great axial forces in the ceramic annular stacks. Even in the case of comparatively low isostatic pressures, the axial forces may increase to such an extent that rupturing of the rings occurs due to the Hertzian stress caused by the point contact on the spherical segments.

Configuring the spacers in the form of spherical segments has further technical and commercial disadvantages. Since rings with spacers formed in such a way cannot be reworked cost-effectively after sintering, the planarity of the annular discs and the height of the spherical segments must comply exactly to the prescribed specification, since otherwise the rings cannot be used and have to be discarded. Even when keeping within the technically possible tolerances, ceramic components that are said to be "as sintered", i.e. not reworked, have greater tolerances than those that have been reworked by hard machining. Consequently, close tolerances of the filter width cannot be cost-effectively achieved with the rings that have spacers in the form of spherical segments. The disadvantages also include that a specially adapted pressing tool has to be available for every filter width to be produced. At least the upper punches of the pressing tool must be adapted to the height of the spherical segments, and consequently to the intended filter width, which entails considerable commercial disadvantages.

A further disadvantage of the structural designs proposed in DE 10 2008 057 894 A1, WO2011/009469 A1 and WO2011/120539 A1 concerns the compression springs. These compression springs, configured as spiral springs, are intended to keep the pre-loading of the ceramic annular discs constant under changing ambient conditions, in particular changing temperature. The intended effect of the springs distributed over the circular circumference of the annular discs is to hold the discs together, and thus keep the filter gap width constant, with a force that is largely independent of ambient influences. Under certain operating conditions that can occur when the filters are actually being used in extraction operations, however, the springs behave in a way other than that desired. On account of the difference in pressure between the inflow side of the filter, which is generally on the outer circumferential surface of the annular discs, and the outflow side on the inner circumferential surface of the annular discs, axial compressive forces occur in the filter gap, it being possible for the axial forces to be considerable even when there is little difference in pressure, on account of the width of the annular discs. These axial forces may be greater than the resilient forces of the compression springs, which has the result that, as from a certain difference in pressure, the springs yield and one or more filter gaps change in an undesired way, which results in loss of the desired and intended filtering effect. It is not possible with the proposed structural designs to increase the spring preloading at will, since otherwise the Hertzian stress leads to rupturing of the ceramic filter rings even when the filter is not subjected to any loading.

With the compression springs, a spring force that is uniform over the circumference of the annular discs is exerted on the annular discs, offering a force of equilibrium to counter a very homogeneous isostatic pressure field inside or outside the filter. Tests with such filters show that, under technically realistic conditions, the compressive force fields are not homogeneous and the springs cannot prevent undesired tilting of the annular discs.

The compression springs can lose their intended effect to the extent that they lead to functional incapacity, or at least to failure of the intended filtering effect.

In the case of DE 10 2008 057 894 A1, WO2011/009469 A1 and WO2011/120539 A1, the annular discs are stacked in such a way that the spacers in the form of spherical segments must respectively lie one over the other. This technical solution has disadvantages to the extent that on the one hand assembly is complex, since the exact orientation of the rings has to be ensured, and on the other hand there is the risk of the filter becoming functionally incapable, because the rings twist under the effect of influences occurring when they are being transported or during operation.

In the case of WO2011/009469 A1, the brittle-hard annular discs have on their circumferential surface grooves for receiving guide rods, which serve for aligning and guiding the annular elements during assembly. In WO2011/120539 A1, the brittle-hard discs of the annular stack are held together by clamping rods that lie within the annular stack and are parallel to the longitudinal axis or a clamping tube that lies within the annular stack. On the inner circumferential surface, the brittle-hard discs have clearances or grooves for receiving the clamping rods. The grooves in the brittle-hard discs that are necessary for guiding the axially parallel clamping elements, like the grooves from WO2011/009469 A1, represent a significant mechanical weakening of the brittle-hard discs, since stress peaks occur at the grooves when the brittle-hard discs are subjected to the loading of external or internal pressures that occur during testing or operation. This leads to a lower load-bearing capacity of the filter system in terms of internal and external pressure.

It is known that temperatures of around 5000° C. prevail at the centre of the Earth. In the direction of the Earth's surface, there is a temperature gradient, with the result that boreholes generally become warmer at increasing depth. It is known from deep wells that, at a depth of 8000 meters, temperatures of about 250° C. can prevail. In extraction wells for oil and gas or else water, high temperatures must therefore be expected. The main need for separating devices that are used in extraction wells for oil and gas or else water is in the temperature range of up to 200° C. Separating devices that are used in extraction wells for oil and gas or water must therefore be capable of functioning in the temperature range of 10 to 200° C. When they are being transported and being stored, the separating devices may also be exposed to lower temperatures of down to −30° C., which the separating devices must be able to withstand undamaged.

It is therefore desirable to provide a wear-resistant separating device for the removal of solid particles from liquids, in particular from oil, gas and water, from extraction wells that has a great resistance to differences in pressure between the inflow side and the outflow side of the separating device. It is also desirable that the separating device withstands differences in temperature of at least 190° C., i.e. in the range of +10° C. to +200° C., during operation undamaged and without restricting its functional capacity. Furthermore, the separating device should be able to withstand undamaged the low temperatures occurring during transport and storage of down to −30° C. Furthermore, it is desired that the separating device can be used in curved extraction wells, is mechanically robust and meets the stringent requirements with regard to safety and reliability of the oil and gas industry.

SUMMARY

The present invention provides a separating device according to Claims 1 and 2 and also the use thereof according to Claims 23 and 24. Preferred and particularly expedient embodiments of the separating device are specified in the dependent claims 3 to 22.

The subject matter of the invention is consequently a separating device for removing solid particles from liquids and/or gases, comprising a) an annular stack of at least three brittle-hard annular discs, the upper side of the annular discs having at least three spacers, which are distributed uniformly over the circular circumference of the discs and the contact area of which is planar, so that the spacers have planiform contact with the underside of an adjacent annular disc, and the annular discs being stacked and fixed in such a way that between the individual discs there is in each case a separating gap for the removal of solid particles, and the axial projection of the annular discs at the inner and the outer circumference being circular, and the brittle-hard material of the annular discs being chosen from oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ and long- and/or short-fibre-reinforced ceramic materials, b) a perforated pipe, which is located inside the annular stack and on which the brittle-hard annular discs are stacked, c) at least three bands, which are provided axially parallel and uniformly spaced apart on the lateral surface of the perforated pipe located inside the annular stack and onto which the annular discs have been pushed, whereby the annular discs are centred on the perforated pipe, and d) an end cap at the upper end and an end cap at the lower end of the annular stack, the end caps being firmly connected to the perforated pipe.

The subject matter of the invention is also a separating device for removing solid particles from liquids and/or gases, comprising a) an annular stack of at least three brittle-hard annular discs, the upper side and underside of every second annular disc in the annular stack having at least three spacers distributed uniformly over the circular circumference of the discs, while the respectively adjacent annular discs have no spacers, and the contact area of the spacers being planar, so that the spacers have planiform contact with the adjacent annular discs, and the annular discs being stacked and fixed in such a way that between the individual discs there is in each case a separating gap for the removal of solid particles, and the axial projection of the annular discs at the inner and the outer circumference being circular, and the brittle-hard material of the annular discs being chosen from oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ and long- and/or short-fibre-reinforced ceramic materials, b) a perforated pipe, which is located inside the annular stack and on which the brittle-hard annular discs are stacked, c) at least three bands, which are provided axially parallel and uniformly spaced apart on the lateral surface of the perforated pipe located inside the annular stack and onto which the annular discs have been pushed, whereby the annular discs are centred on the perforated pipe, and d) an end cap at the upper end and an end cap at the lower end of the annular stack, the end caps being firmly connected to the perforated pipe.

The subject matter of the invention is also the use of the separating device according to the invention for removing solid particles from liquids and/or gases in a process for extracting liquids and/or gases from extraction wells.

The subject matter of the invention is also the use of the separating device according to the invention for removing solid particles from liquids and/or gases in naturally occurring bodies of water or in storage installations for liquids and gases.

The separating device according to the invention has good resistance to differences in pressure. It can withstand external pressures of up to 500 bar (or 50 MPa or 7250 psi) and more in the test for external pressure resistance (collapse pressure test) according to ISO 17824 and internal pressures of up to 120 bar (or 12 MPa or 1740 psi) and more in the test for internal pressure resistance (burst pressure test) according to ISO 17824 without restricting its functional capacity. In these tests for internal and external pressure resistance, there is no rupturing of any of the brittle-hard annular discs.

The internal and external pressure resistance of the separating device according to the invention is consequently much greater than in the case of the separating devices according to DE 10 2008 057 894 A1, WO2011/009469 A1 and WO2011/120539 A1.

The planar contact areas of the spacers have the effect that the annular discs have planiform contact with the respectively adjacent annular discs. As a result, point pressure loads are avoided, so that the risk of overloading due to the Hertzian stress and of rupturing of the brittle-hard annular discs is significantly reduced in comparison with the separating devices of DE 10 2008 057 894 A1, WO2011/009469 A1 and WO2011/120539 A1 with the spacers in the form of spherical segments.

The separating device according to the invention does not have any yielding-elastic structural elements such as springs, rubber discs or other elastic elements that bring about pre-loading. The annular stack of the separating device is not braced by way of compression springs, but is fixed on the perforated pipe located inside the annular stack without the annular stack undergoing any appreciable pre-loading. Dispensing with the compression springs has the effect that tilting of the annular discs cannot occur.

When the separating device is subjected to pressure from the inside or the outside, axial forces occur on the annular discs as a result of the liquid pressure, which can act on all sides in the filter gap and tries to press the annular discs apart. Depending on the kind of pressure field, which may be distributed uniformly or non-uniformly over the circumference and height of the filter column, the axial forces can occur in the case of a smaller or greater number of the annular discs. With the separating device according to the invention, the supporting of the annular discs against one another and the supporting of the annular stack against the end caps have the effect of preventing axial forces that occur under the effect of pressure causing a measurable displacement of the annular discs in the axial direction. Even when there are great differences in pressure as a result of internal or external pressure loading, the filter gaps do not change in an undesirable way, so that the filtering effect is retained even when there are great differences in pressure.

With the separating device according to the invention, the axial projection of the annular discs at the inner and the outer circumference is circular. Therefore, as a difference from the separating devices proposed in DE 10 2008 057 894 A1, WO2011/009469 A1 and WO2011/120539 A1, the annular discs do not have any strength-reducing grooves or clearances on their inner and outer circumferential surfaces. The circular shape, which is ideal from a structural design viewpoint, has the effect that concentrations of stress as a result of pressure loading are largely avoided. As a result, the internal and external pressure resistance of the separating device is greater.

The production of the annular discs used for the separating device according to the invention can be realized for various filter widths at low cost with a single pressing tool and the exact setting of the filter width can take place by hard machining of the sintered annular discs. For example, filter widths of 10 to 500 μm can be produced with a single pressing tool, which leads to considerable savings in tool costs and stockkeeping.

The annular discs are to some extent movable with respect to one another in radial and tangential directions, whereby the separating device can also be introduced into curved extraction wells.

The separating device according to the invention, constructed from brittle-hard annular elements, is more abrasion- and corrosion-resistant than conventional metallic filters. It therefore has a longer lifetime under corrosive and abrasive conditions of use than the conventional filters.

BRIEF DESCRIPTION OF THE DRAWINGS

The invention is explained in more detail on the basis of the drawings, in which FIG. 1 schematically shows the overall view of a separating device according to the invention.

DETAILED DESCRIPTION

Preferred embodiments and details of the separating device according to the invention are explained in more detail below with reference to the drawings.

Figure 1:
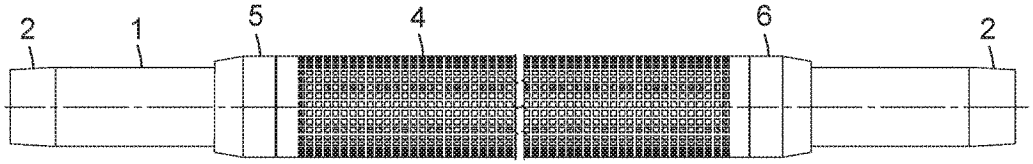

FIG. 1 shows the overall view of a separating device according to the invention. Usually provided at both ends of the perforated pipe 1 are threads 2, by way of which the separating device can be connected to further components, either to further separating devices or to further components of the extraction equipment.

Various embodiments of the separating device according to the invention are described below, the separating devices comprising the following basic elements that are designed appropriately for the materials and made to match one another:

an annular stack 7 (see FIGS. 3*a*-3*b*, 4*a*-4*b*, 5*a*-5*b* and 7*a*-7*f*) of at least three brittle-hard annular discs 8 (see FIGS. 6*a*-6*g* and 8*a*-8*g*), the upper side 9 of which has at least three spacers 10 distributed uniformly over the circular circumference of the discs. The contact area 11 of the spacers 10 is planar, so that the spacers 10 have planiform contact with the adjacent annular disc. The annular discs are stacked and fixed in such a way that between the individual discs there is in each case a separating gap 14 for the removal of solid particles. The axial projection of the annular discs at the inner and the outer circumference is circular. The annular discs therefore do not have any strength-reducing grooves or clearances on their inner and outer circumferential surfaces. The circular shape, which is ideal from a structural design viewpoint, has the effect that concentrations of stress as a result of pressure loading are largely avoided;

a perforated pipe 1 located inside the annular stack 7 (see FIGS. 1, 3*a*-3*b*, 4*a*-4*b* and 5*a*-5*b*), on which the brittle-hard annular discs 8 are stacked. The perforated pipe located inside the annular stack is also referred to hereinafter as the basepipe;

at least three bands 15 (see FIGS. 10 and 11), which are provided axially parallel and uniformly spaced apart on the lateral surface of the basepipe 1, onto which the annular discs 8 have been pushed, whereby the annular discs 8 are centred on the basepipe 1; and tWOend caps 5, 6 (see FIGS. 1, 3*a*-3*b*, 4*a*-4*b* and 5*a*-5*b*) at the upper and lower ends of the annular stack 7, the end caps 5, 6 being firmly connected to the basepipe 1.

For better understanding, and since the separating device according to the invention is generally introduced into the extraction borehole in vertical alignment, the terms "upper" and "lower" are used here, but the separating device may also be positioned in horizontal orientation in the extraction borehole.

Annular Stack

Figure 6A:
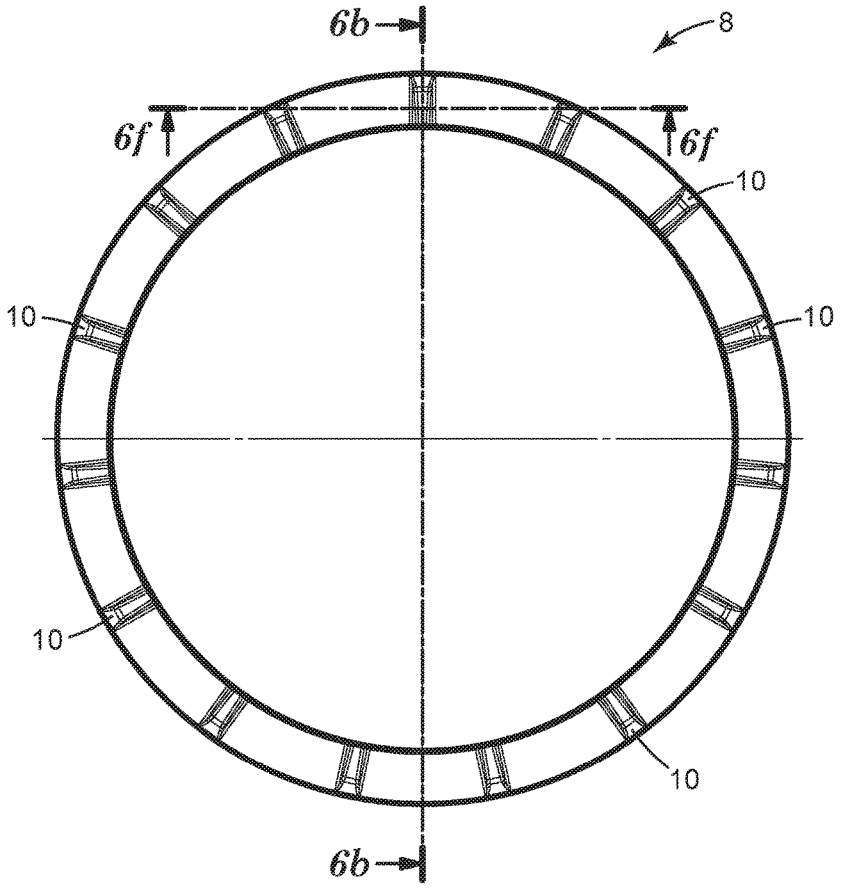
FIGS. 6*a*-6*g* show various views of an annular disc according to the invention with 15 spacers on the upper side of the annular disc.
Figure 6B:
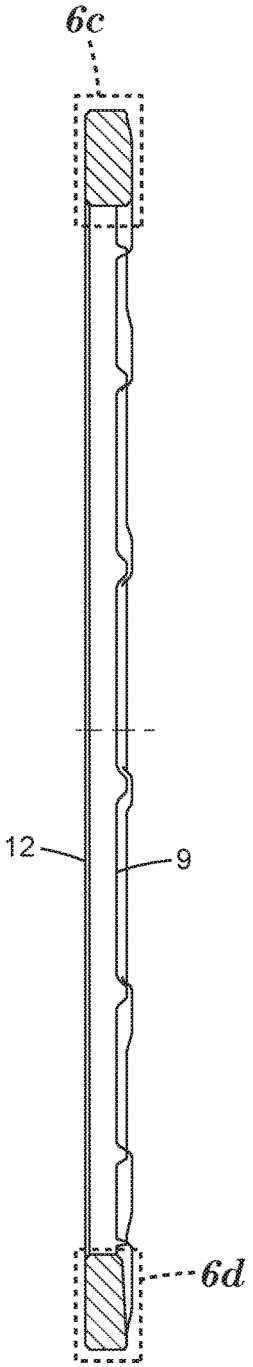
Figure 6C:
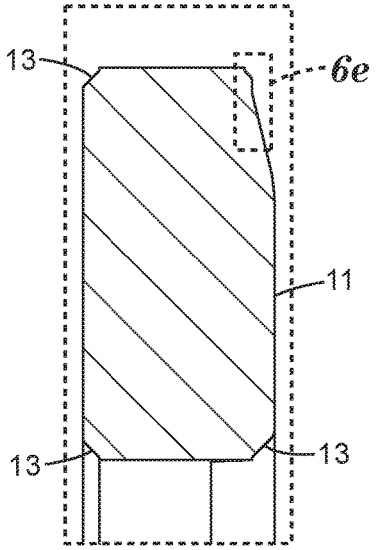
Figure 6D:
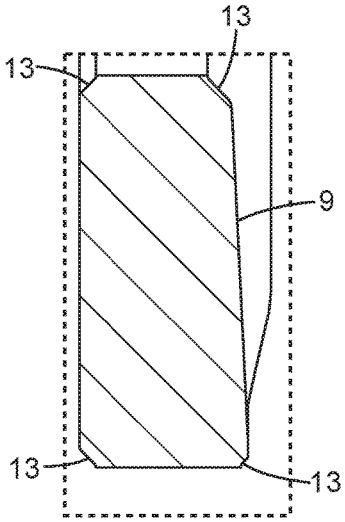
Figure 6E:
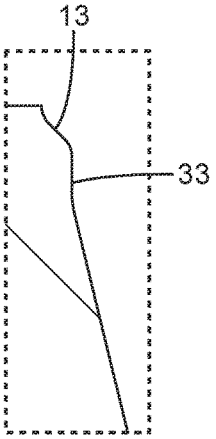
Figure 8A:
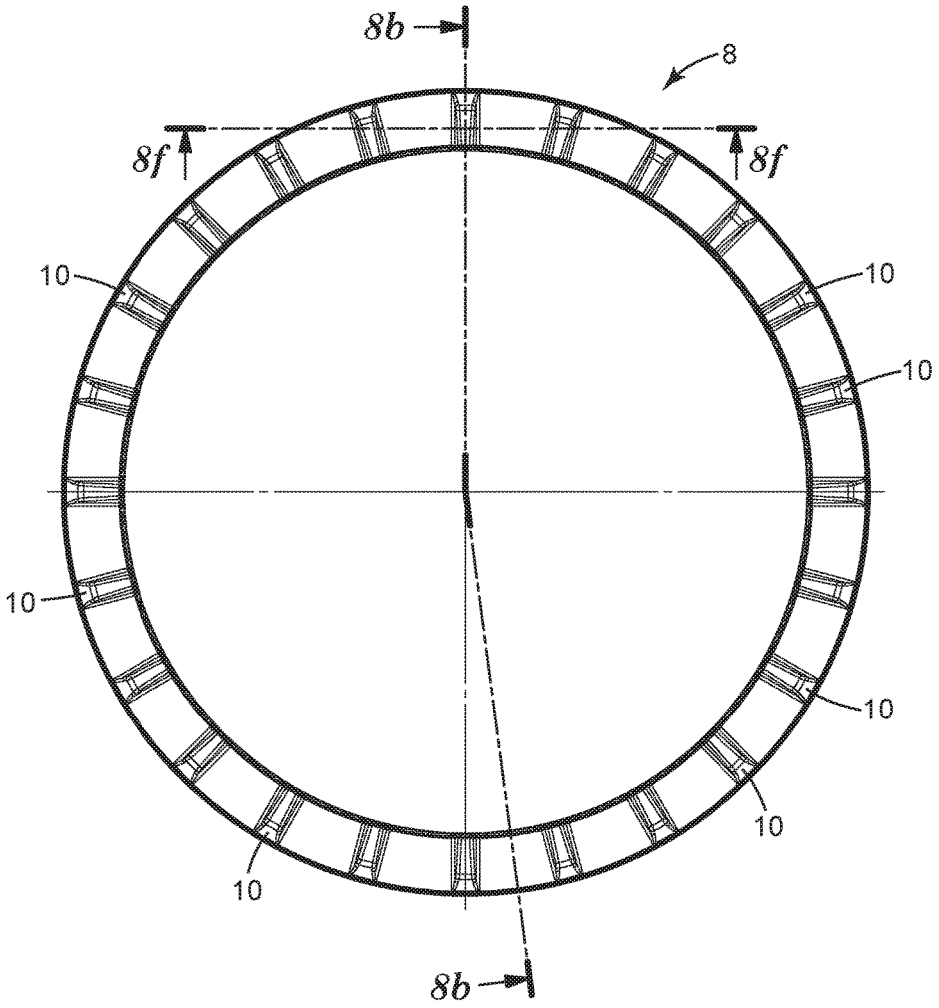
FIGS. 8*a*-8*g* show various views of an annular disc according to the invention with 24 spacers on the upper side of the annular disc.
Figure 8B:
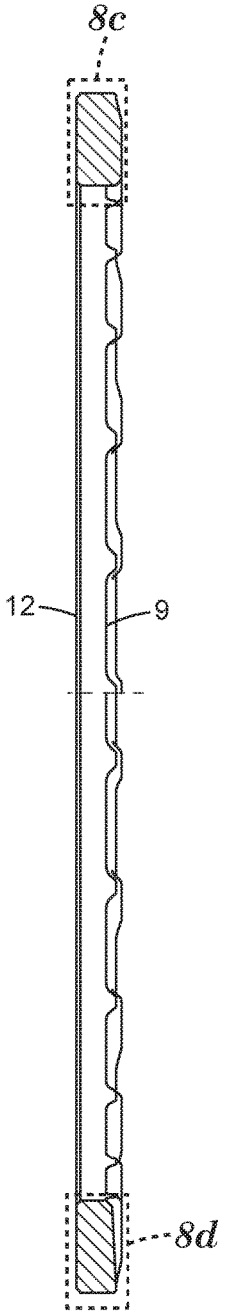
Figure 8C:
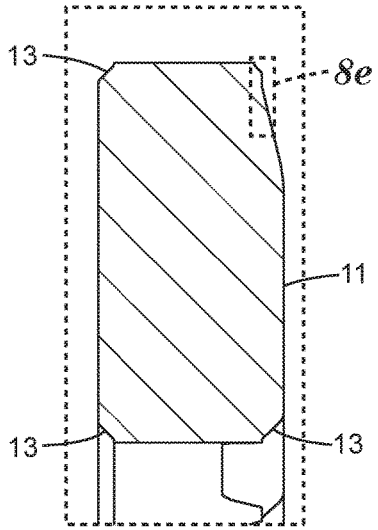
Figure 8E:
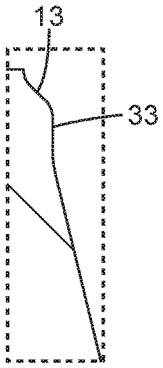
Figure 8D:
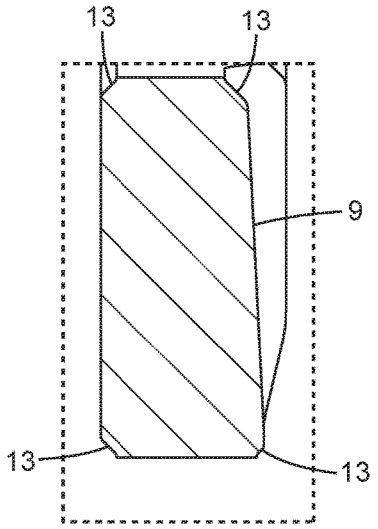

In FIGS. 6*a*-6*g* and 8*a*-8*g* tWOpreferred embodiments of the annular discs 8 that are used for the separating device according to the invention are represented. Block of FIG. 6 shows the design of the annular discs for an embodiment with 15 spacers on the upper side of the annular disc, Block of FIG. 8 shows the design of the annular discs for an embodiment with 24 spacers on the upper side of the annular disc. FIGS. 6*a* and 8*a* respectively show a plan view of the annular disc 8, FIGS. 6*b* and 8*b* respectively show a cross-sectional view along the sectional line denoted in FIGS. 6*a* and 8*a* by "6*b*" and "8*b*", respectively. FIGS. 6*c*-6*e* and 8*c*-8*e* show enlarged details of the cross-sectional views of FIGS. 6*b* and 8*b*, respectively, FIGS. 6*f* and 8*f* respectively show a 3D representation along the sectional line denoted in FIGS. 6*a* and 8*a* by "6*f*" and "8*f*", respectively, and FIGS. 6*g* and 8*g* respectively show a 3D view of the annular disc. The configuration of the spacers represented in FIGS. 6*a*-6*g* and 8*a*-8*g* is a preferred form of the spacers.

The annular discs are produced from a brittle-hard material, preferably from a ceramic material, which is abrasion- and erosion-resistant to solid particles such as sands and other mineral particles and also corrosion-resistant to the extraction media and the media used for maintenance, such as for example acids.

Figure 6F:
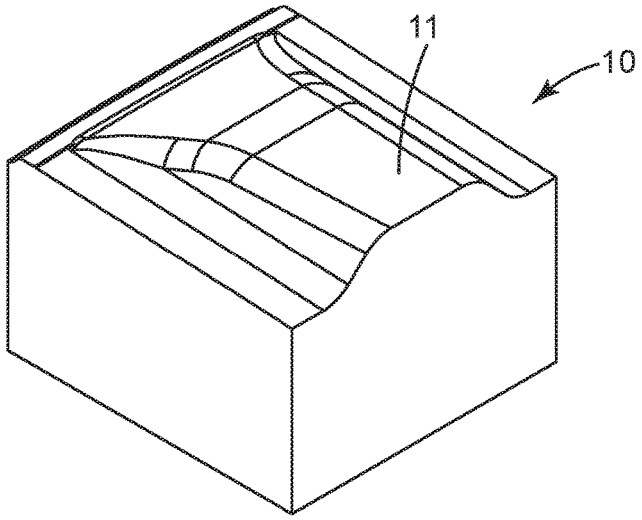
Figure 6G:
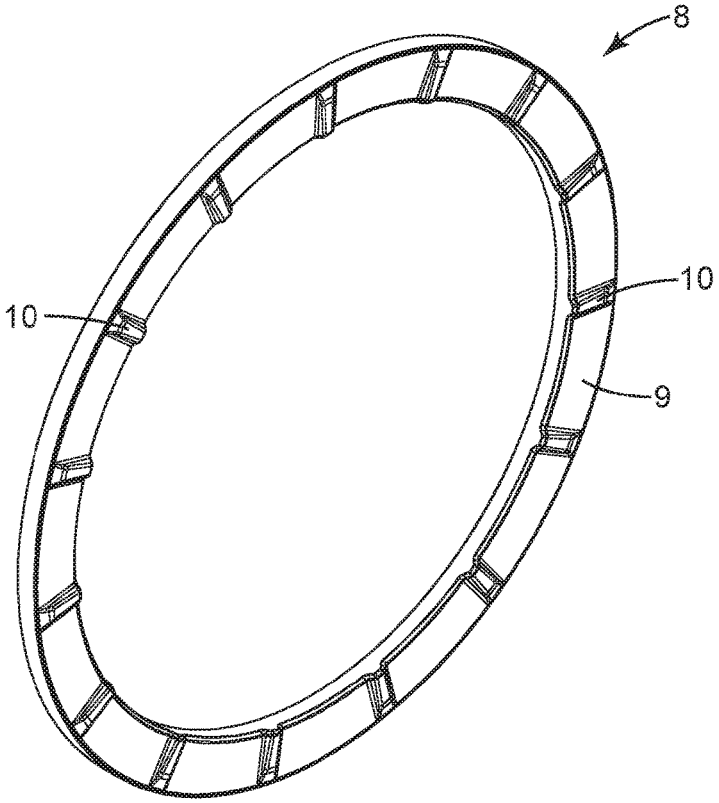
Figure 7A:
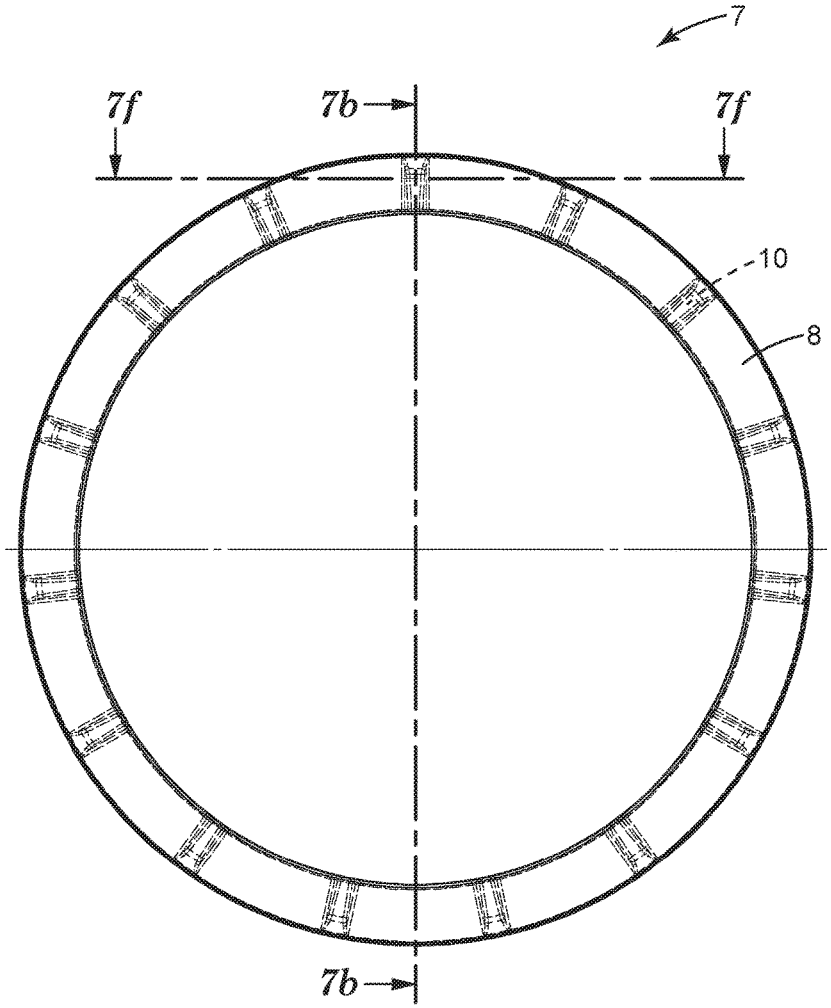
FIGS. 7*a*-7*f* schematically show various views of an annular stack with annular discs according to FIGS. 6*a*-6*g;*
Figure 7B:
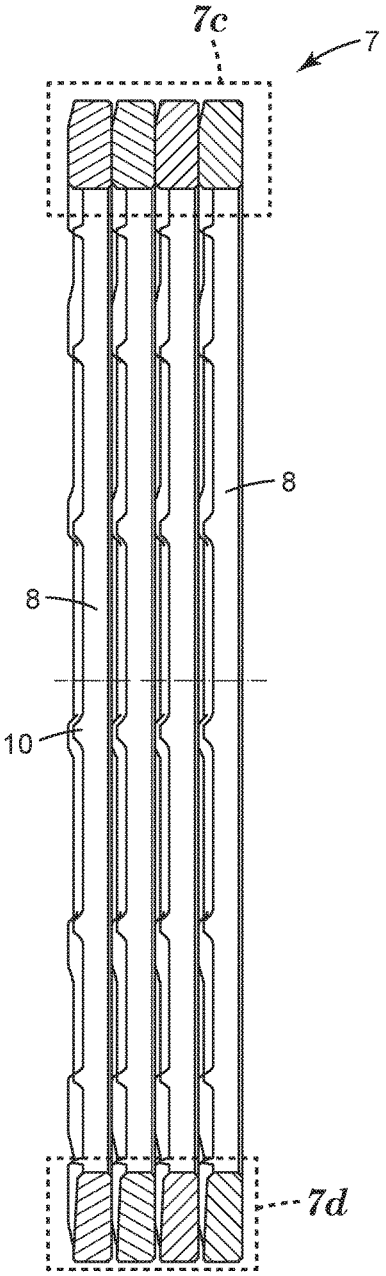
Figure 7C:
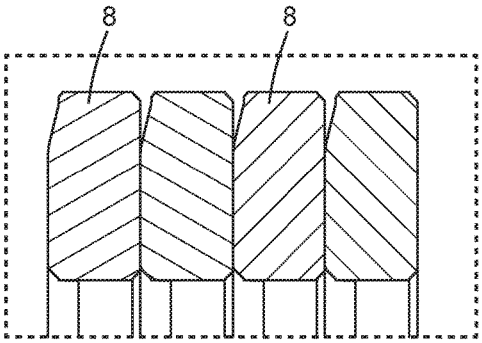
Figure 7D:
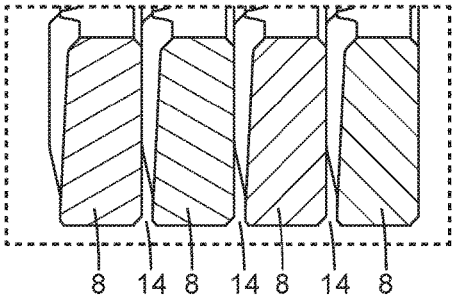
Figure 7E:
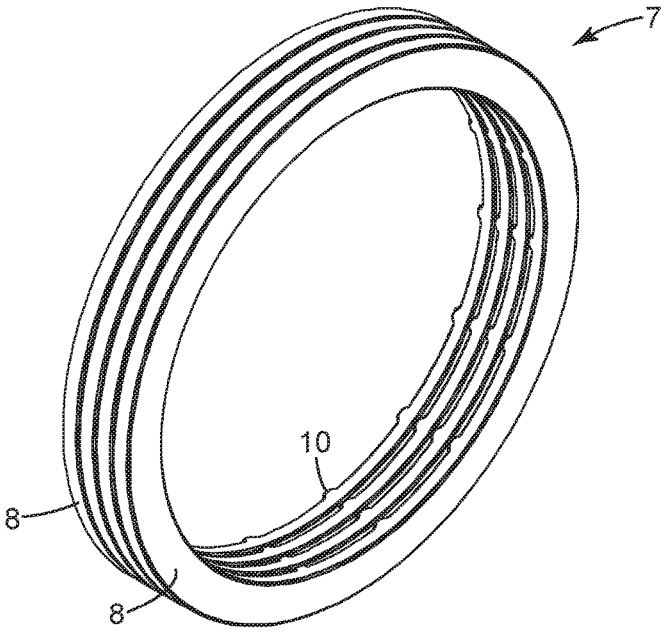
Figure 7F:
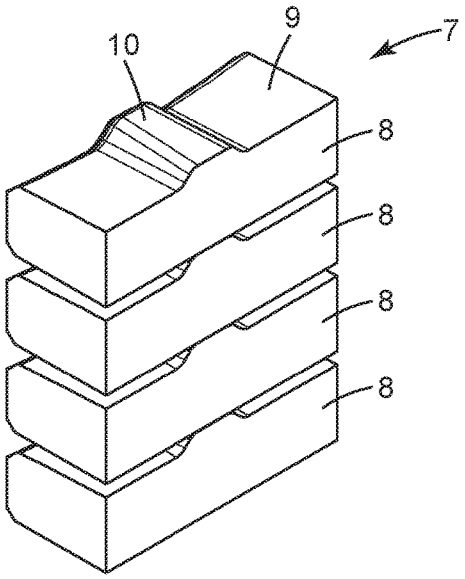

FIGS. 7*a*-7*f* schematically show an annular stack 7 constructed from annular discs 8 of FIGS. 6*a*-6*g*. FIG. 7*a* shows a plan view of the annular stack, FIG. 7*b* shows a cross-sectional view along the sectional line denoted in FIG. 7*a* by "7*b*". FIGS. 7*c* and 7*d* show enlarged details of the cross-sectional view from FIG. 7*b*. FIG. 7*e* shows a 3D view of the annular stack, FIG. 7*f* shows a 3D representation along the sectional line denoted in FIG. 7*a* by "7*f*".

The removal of the solid particles takes place at the inlet opening of an annular gap 14, which is preferably divergent, i.e. opening, in the direction of flow (see FIGS. 7*b* and 7*d*) and is formed between tWOannular elements lying one over the other. The annular elements are designed appropriately for ceramic or appropriately for brittle-hard materials, i.e. cross-sectional transitions are configured without notches and the occurrence of flexural stresses is largely avoided by the structural design.

The annular discs 8 (see Blocks of FIGS. 6 and 8) have on their upper side 9 at least three spacers 10 distributed uniformly over the circular circumference of the discs and of a defined height, with the aid of which the height of the separating gap 14 (gap width of the filter gap, filter width) is set. The spacers are not separately applied or subsequently welded-on spacers, they are formed directly in production, during the shaping of the annular discs. The annular discs are consequently monolithic bodies and the spacers have the same great abrasion, erosion and corrosion resistance as the annular discs.

The contact area 11 of the spacers 10 is planar (see FIGS. 6*c*, 6*f*, 8*c* and 8*f*), so that the spacers 10 have planiform contact with the adjacent annular disc. The annular discs 8 are plane-parallel with the underside 12 of the annular discs 8 in the region of the contact area 11 of the spacers 10, i.e. in the region of contact with the adjacent annular disc 8. The underside 12 of the annular discs is formed as smooth and planar and at right angles to the disc axis.

The upper side 9 of the annular discs is preferably inwardly or outwardly sloping, particularly preferably inwardly sloping, in the regions between the spacers. If the upper side of the annular discs is inwardly or outwardly sloping in the regions between the spacers, in the simplest case the sectional line on the upper side of the ring cross-section of the annular discs is straight and the ring cross-section of the annular discs in the portions between the spacers is trapezoidal (see FIGS. 6*d* and 8*d*), the thicker side of the ring cross-section having to lie on the respective inlet side of the flow to be filtered. If the flow to be filtered comes from the direction of the outer circumferential surface of the annular stack, the thickest point of the trapezoidal cross-section must lie on the outside and the upper side of the annular discs is inwardly sloping. If the flow to be filtered comes from the direction of the inner circumferential surface of the annular disc, the thickest point of the trapezoidal cross-section must lie on the inside and the upper side of the annular discs is outwardly sloping. The forming of the ring cross-section in a trapezoidal shape, and consequently the forming of a filter gap that diverges in the direction of flow, has the advantage that, after passing the narrowest point of the filter gap, irregularly shaped particles, i.e. non-spherical particles, tend much less to get stuck in the filter gap, for example due to rotation of the particles as a result of the flow in the gap. Consequently, a separating device with a divergent filter gap formed in such a way is less likely to become plugged and clogged than a separating device in which the filter gaps have a filter opening that is constant over the ring cross-section, in the case of which the upper side of the ring and the underside of the ring are therefore parallel.

The outer contours of the annular discs are preferably configured with a bevel 13, as illustrated in FIGS. 6*c*-6*e* and 8*c*-8*e*. It is also possible to configure the annular discs with rounded edges. This represents even better protection of the edges from the edge loading that is critical for brittle-hard materials.

The circumferential surfaces (lateral surfaces) of the annular discs are preferably cylindrical. However, it is also possible to form the circumferential surfaces as outwardly convex, in order to achieve a better incident flow.

The annular discs are produced with an outside diameter that is adapted to the borehole of the extraction well provided in the application concerned, so that the separating device according to the invention can be introduced into the borehole with little play, in order to make best possible use of the cross-section of the extraction well for achieving a high delivery output. The outside diameter of the annular discs may be 20-250 mm, but outside diameters greater than 250 mm are also possible.

The radial ring width of the annular discs preferably lies in the range of 8-20 mm. These ring widths are suitable for separating devices with basepipe diameters in the range of 2⅜ to 5½ inches.

The axial thickness of the annular discs is preferably 3-12 mm, more preferably 4-7 mm. The axial thickness or base thickness of the annular discs is measured in the region between the spacers and, in the case of a trapezoidal cross-section, on the thicker side in the region between the spacers.

The axial thickness of the annular discs in the region of the spacers corresponds to the sum of the base thickness, i.e. the axial thickness of the annular discs in the region between the spacers, and the filter width.

The height of the spacers determines the filter width of the separating device, that is to say the separating gap between the individual annular discs. The filter width additionally determines which particle sizes of the solid particles to be removed, such as for example sand and rock particles, are allowed to pass through by the separating device and which particle sizes are not allowed to pass through. The height of the spacers is specifically set in the production of the annular discs.

The filter width of the annular stack can be set to values between 10 μm and 5000 μm, preferably to values between 20 μm and 1000 μm and particularly preferably to values between 50 μm and 500 μm.

The deviation of the annular discs from the ideal circular shape at the inner and the outer circumference is preferably <0.5%, with respect to the outside diameter of the ring. Thus, for example in the case of annular discs with an outside diameter of 170 mm that are used on a basepipe with an outside diameter von 5½ inches, corresponding to 139.7 mm, the roundness of the rings is less than 0.5% of 170 mm, that is to say less than 0.85 mm.

As already stated, the spacers arranged on the upper side of the annular discs have planiform contact with the adjacent annular disc. The spacers make a radial throughflow possible and are therefore preferably arranged radially aligned on the upper side of the annular discs. The spacers may, however, also be aligned at an angle to the radial direction.

The spacers arranged on the upper side of the annular discs may extend over the entire radial width of the annular discs. However, it is also possible that the spacers are aligned in such a way that they do not extend over the entire radial width of the surface of the annular discs, but only take up part of this width. In this case, the spacers preferably take up the part of the width of the annular discs that is located on the filter outlet side of the annular discs, which is generally at the inner circumference of the annular discs. If the spacers only take up part of the width of the annular discs, an increase in the number of spacers does not necessarily mean that there is an associated undesired decrease in the filter inlet area. These spacers are advantageous in that, with virtually the same supporting effect of the spacers, the annular inlet gap of the filter is not reduced by the spacers, or only a little, which leads to the desired great filter inlet cross-section. The greater the filter inlet cross-section, the greater the volumetric flow that can be filtered. Conversely, when there is a small volumetric flow, the separating device can be made with a smaller configuration, which makes it economically more attractive and is conducive to it being installed in confined spaces.

Figure 9A:
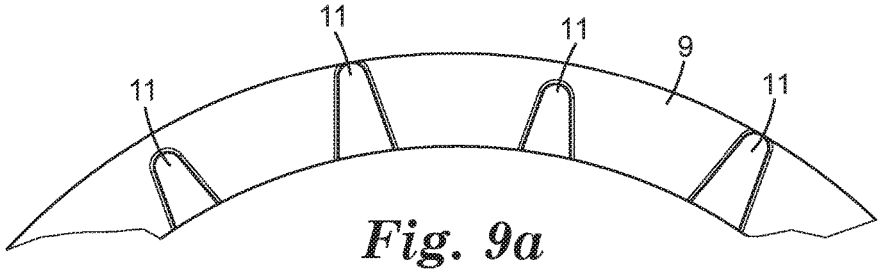
FIGS. 9*a*-9*e* respectively show a detail of the upper side of an annular disc according to the invention with variously configured spacers.
Figure 9B:
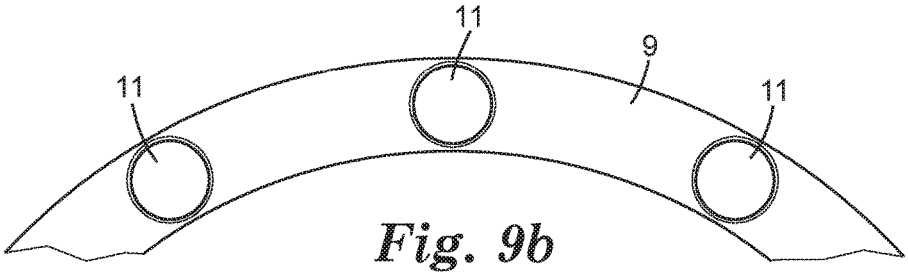
Figure 9C:
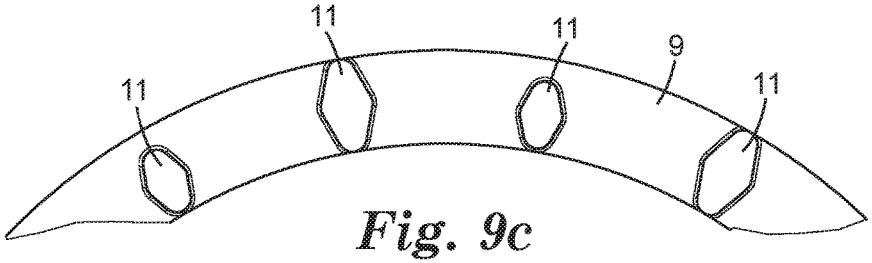
Figure 9D:
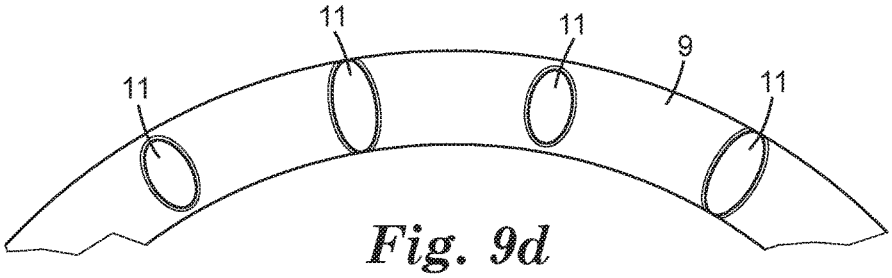
Figure 9E:
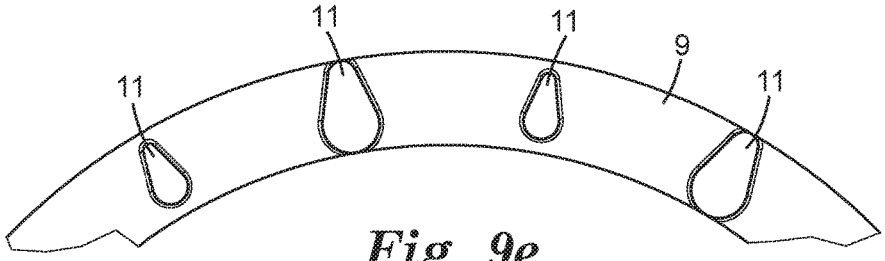

Spacers that only take up part of the radial width of the surface of the annular discs are preferably arranged on the annular discs in alternation with spacers that extend over the entire radial width. This is illustrated in FIG. 9*a* and also 9*c*-9*e*. A detail of the upper side of an annular disc is respectively represented here.

Figure 8F:
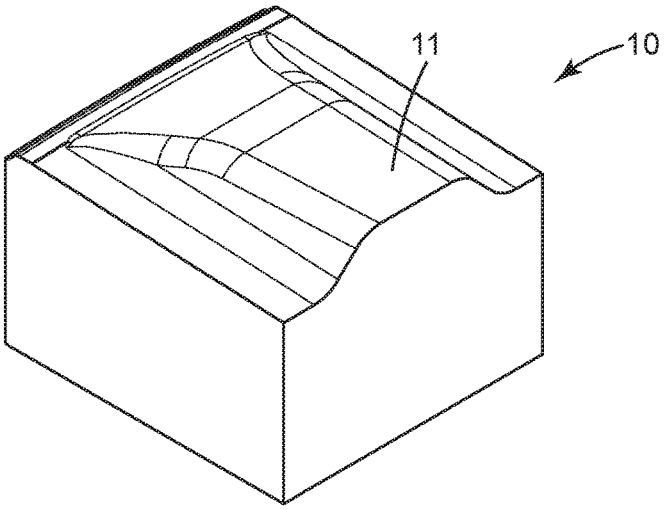
Figure 8G:
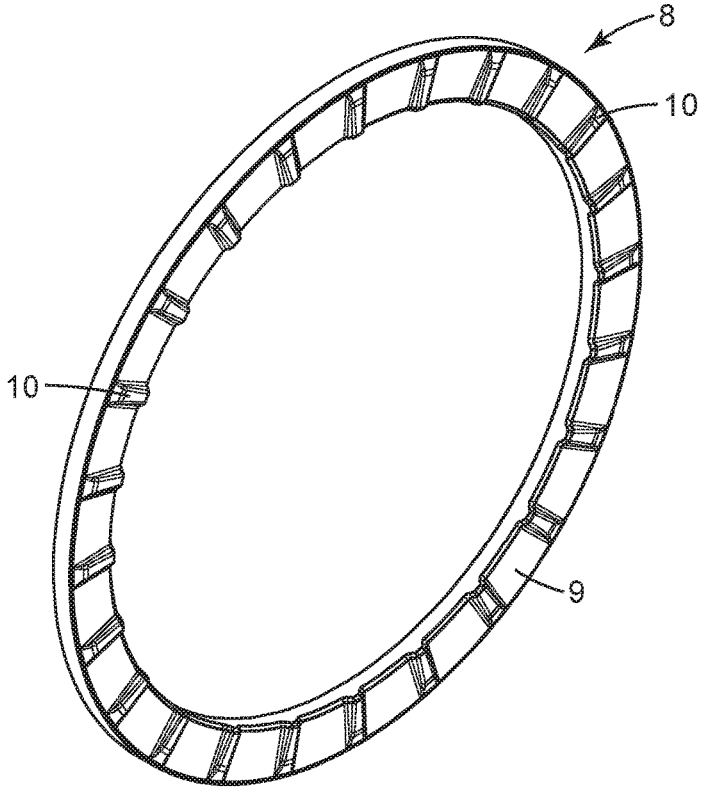

The transitions between the upper side of the annular discs and the spacers are preferably not formed in a step-shaped or sharp-edged manner. Rather, the transitions between the upper side of the annular discs and the spacers are configured appropriately for ceramic, i.e. the transitions are made with radii that are gently rounded. This is illustrated in FIGS. 6*f* and 8*f*.

The contact area 11 of the spacers 10, that is to say the planar area with which the spacers are in contact with the adjacent annular disc, may be rectangular, round, rhomboidal, elliptical, trapezoidal or else triangular, while the shaping of the corners and edges should always be appropriate for ceramic, i.e. rounded. Various configurations of the spacers with various contact areas 11 are represented in FIGS. 9*a*-9*e*.

One possible embodiment of spacers that only take up part of the radial width of the surface of the annular discs is shown by FIG. 9*a*. The form of the spacers that is represented in FIG. 9*a* is approximately triangular, i.e. triangular with edges rounded off appropriately for ceramic. This form is advantageously designed in such a way that the flow cross-section in the filter gap does not decrease in the direction of flow. The width of the contact area of these spacers increases inwardly, while the upper side of the annular disc slopes inwardly. According to the operationally dependent direction of flow, the narrow side of the approximately triangular spacer may be facing towards or away from the centre point of the ring.

The width of the contact area 11 of the spacers is measured in the radial direction, as the greatest extent in the radial direction. The width of the contact area of the spacers is less than or equal to the radial width of the annular discs and is preferably at least 60% of the radial ring width. The width of the spacers may be shortened slightly at the outer circumference of the annular discs for the incorporation of measuring reference areas 33, for example by approximately 0.3 mm (see FIGS. 6*e* and 8*e*). The measuring reference areas serve for simplified measurement of the filter width, in particular automated measurement.

The length of the contact area 11 of the spacers is measured in the circumferential direction, as the greatest extent in the circumferential direction. The length of the contact area of the spacers preferably lies between 1 mm and 12 mm, and particularly preferably between 2 mm and 5 mm. These lengths have proven to be particularly successful in pressure tests and in the production of the annular discs.

Depending on the size of the annular discs, the contact area 11 of the individual spacers preferably lies between 4 and 60 $mm^2$, more preferably between 10 and 35 $mm^2$. At least three spacers 10 are arranged uniformly over the circular circumference of the annular discs (see Blocks of FIGS. 6 and 8). The number of spacers may be even or odd. The liquid pressure acting in the filter gap when it is being flowed through also exerts flexural stress on the annular discs. The interspace or span, determining the pressure resistance, is the distance between adjacent spacers. The fewer spacers are arranged on the annular discs, the lower the pressure resistance of the separating device. Although the free filter area decreases undesirably with an increasing number of spacers, in return the pressure resistance of the filter system increases, since the interspace or span decreases. More than three spacers are preferably provided, more preferably at least 6, more preferably at least 10 and particularly preferably at least 15. The number of spacers can be selected according to the application concerned or the pressure conditions to be expected, and depending on the mechanical properties of the material that is used for the annular discs. The higher the pressures to be expected during operation, the more spacers should be provided in the structural design. The larger the annular discs, the more spacers should generally be provided in the structural design. Thus, for annular discs with an outside diameter of 100 mm (for a base-pipe outside diameter of 2⅞ inches), for example, 16 spacers may be provided, in the case of an outside diameter of 115 mm (for a base-pipe outside diameter of 3½ inches), for example, 18 spacers may be provided and in the case of an outside diameter of 168 mm (for a base-pipe outside diameter of 5½ inches), for example, 24 spacers may be provided.

The distance between the spacers is measured in the circumferential direction as the distance between the centres of the contact areas of the spacers along the inside diameter. The distance between the spacers preferably lies in the range of 8 to 50 mm, more preferably between 10 and 30 and particularly preferably between 15 and 25 mm. The distance between the spacers has an influence on the resistance to internal and external pressure loading, as can occur in the test for internal and external pressure resistance according to ISO 17824 and also under operating conditions. The smaller the distance between the spacers, the greater the internal and external pressures that the separating device withstands before loss of the filtering effect occurs.

The distance between the spacers can be used to derive the number of spacers for the various sizes of the annular discs. For outside diameters of the annular discs in the range of 80 to 110 mm, preferably 6 to 35 spacers are provided, more preferably 9 to 28, particularly preferably 11 to 19. For outside diameters of the annular discs in the range of >110 to 140 mm, preferably 7 to 42 spacers are provided, more preferably 11 to 33, particularly preferably 13 to 22. For outside diameters of the annular discs in the range of >140 to 200 mm, preferably 10 to 62 spacers are provided, more preferably 16 to 49, particularly preferably 20 to 33.

The annular discs may be stacked one on top of the other in any desired or random orientation, without the function of the separating device being impaired. It is therefore not necessary that the spacers of the annular discs are respectively positioned exactly in line one over the other. This possibility of desired or random orientation in the stacking facilitates the assembly of the separating device considerably and also has the effect that the production costs are lower than in the case of stacking with spacers oriented exactly one over the other. However, it is also possible to position the spacers in the annular stack respectively in line one over the other, as represented in FIG. 7*f*.

The brittle-hard material of the annular discs is chosen from oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ and long- and/or short-fibre-reinforced ceramic materials.

Examples of oxidic ceramic materials are materials on the basis of $Al_2O_3$, $ZrO_2$, mullite, spinel and mixed oxides. Examples of non-oxidic ceramic materials are SiC, $B_4C$, $TiB_2$ and $Si_3N_4$. Ceramic hard materials are, for example, carbides and borides. Examples of mixed materials with a metallic binding phase are WC—Co, TiC—Fe and $TiB_2$—FeNiCr. Examples of hard material phases formed in situ are chromium carbides. An example of fibre-reinforced ceramic materials is C/SiC. The material group of fibre-reinforced ceramic materials has the advantage that it leads to still greater internal and external pressure resistance of the separating devices on account of its greater strength in comparison with monolithic ceramic.

The aforementioned materials are distinguished by being harder than the typically occurring hard particles, such as for example sand and rock particles, that is to say the HV (Vickers) or HRC (Rockwell method C) hardness values of these materials lie above the corresponding values of the surrounding rock. Materials suitable for the annular discs of the separating device according to the invention have HV hardness values greater than 15 GPa, preferably greater than 23 GPa.

All these materials are at the same time distinguished by having greater brittleness than typical unhardened steel alloys. In this sense, these materials are referred to herein as "brittle-hard".

Materials suitable for the annular discs of the separating device according to the invention have moduli of elasticity greater than 200 GPa, preferably greater than 350 GPa.

Materials with a density of at least 90%, more preferably at least 95%, of the theoretical density are preferably used, in order to achieve the highest possible hardness values and high abrasion and erosion resistances. Sintered silicon carbide (SSiC) or boron carbide is preferably used as the brittle-hard material. These materials are not only abrasion-resistant but also corrosion-resistant to the treatment fluids usually used for flushing out the separating device and stimulating the borehole, such as acids, for example HCl, bases, for example NaOH, or else steam.

Particularly suitable are, for example, SSiC materials with a fine-grained microstructure (mean grain size<5 μm), such as those sold for example under the names 3M™ silicon carbide type F and 3M™ silicon carbide type F plus from ESK Ceramics GmbH & Co. KG. Furthermore, however, coarse-grained SSiC materials may also be used, for example with a bimodal microstructure, preferably 50 to 90% by volume of the grain size distribution consisting of prismatic, platelet-shaped SiC crystallites of a length of from 100 to 1500 μm and 10 to 50% by volume consisting of prismatic, platelet-shaped SiC crystallites of a length of from 5 to less than 100 μm (3M™ silicon carbide type C from ESK Ceramics GmbH & Co. KG).

Apart from these single-phase sintered SSiC materials, liquid-phase-sintered silicon carbide (LPS-SiC) can also be used as the material for the annular discs. An example of such a material is 3M™ silicon carbide type T from ESK Ceramics GmbH & Co. KG. In the case of LPS-SiC, a mixture of silicon carbide and metal oxides is used as the starting material. LPS-SiC has a higher bending resistance and greater toughness, measured as a Klc value, than single-phase sintered silicon carbide (SSiC).

The annular discs of the separating device according to the invention are produced by the methods that are customary in technical ceramic or powder metallurgy, that is to say preferably by die pressing of pressable starting powders and subsequent sintering. The annular discs are preferably formed on mechanical or hydraulic presses in accordance with the principles of "near-net shaping", debindered and subsequently sintered to densities >90% of the theoretical density. When the size distribution of the filter width has to meet high requirements, i.e. when an exact mean value and small tolerances of the filter width are required, the annular discs must be subjected to 2-sided facing on their upper side and underside. Preferred methods for the two-sided facing are lapping, flat honing and grinding. The hard machining ensures that the annular discs have sufficiently great planiform contact with one another and any point loading is avoided, which is of great importance for great pressure resistance of the mounted separating device.

The facing of the annular discs allows the heights of the flat-formed spacers to be set to accuracies in the micrometer range.

The hard machining also makes it possible to set filter openings specifically to customer requirements from sintered parts with a standard height of the spacers.

The planarity of the rings on both sides should be better than 30 μm, preferably better than 15 μm and particularly preferably better than 5 μm.

Perforated Pipe (Basepipe)

As already mentioned above, the perforated pipe 1 (see FIGS. 1, 3*a*-3*b*, 4*a*-4*b* and 5*a*-5*b*), which is located inside the annular stack and on which the annular discs are stacked, is also referred to as the basepipe. The basepipe is perforated, i.e. provided with holes, in the region of the annular stack; it is not perforated outside the region of the annular stack.

The perforation 18 serves the purpose of directing the filtered medium, i.e. the media flow freed of the solid particles, such as for example gas, oil or mixtures thereof, into the interior of the basepipe, from where it can be transported or pumped away. The basepipe ensures that the overall construction is mechanically stable and held together.

Pipes such as those that are used in the oil and gas industry for metallic filters (wire wrap filter, metal mesh screen) may be used as the basepipe. The perforation is provided in accordance with patterns customary in the industry, for example 30 holes with a diameter of 9.52 mm may be introduced over a basepipe length of 0.3048 m (corresponding to 1 foot).

Threads 2 are usually cut at both ends of the basepipe 1 and can be used for screwing the basepipes together into long strings.

The basepipe consists of a metallic material, usually of steel, for example steel L80. Steel L80 refers to steel that has a yield strength of 80 000 psi (corresponding to about 550 MPa). As an alternative to steel L80, steels that are referred to in the oil and gas industry as J55, N80, C90, T95, P110 and L80Cr13 (see Drilling Data Handbook, 8th Edition, IFP Publications, Editions Technip, Paris, France) may also be used. Other steels, in particular corrosion-resistant alloy and high-alloy steels, may also be used as the material for the basepipe. For special applications in corrosive conditions, basepipes of nickel-based alloys may also be used. It is also possible to use aluminium materials as the material for the basepipe, in order to save weight. Furthermore, basepipes of titanium or titanium alloys may also be used.

The inside diameter of the annular discs must be greater than the outside diameter of the basepipe. This is necessary on account of the differences with regard to the thermal expansion between the metallic basepipe and the annular discs of the brittle-hard material and also for technical reasons relating to flow. It has been found to be favourable in this respect that the inside diameter of the annular discs is at least 0.5 mm and at most 10 mm greater than the outside diameter of the basepipe. The inside diameter of the annular discs is preferably at least 1.5 mm and at most 5 mm greater than the outside diameter of the basepipe.

Centring Bands

Figure 10:
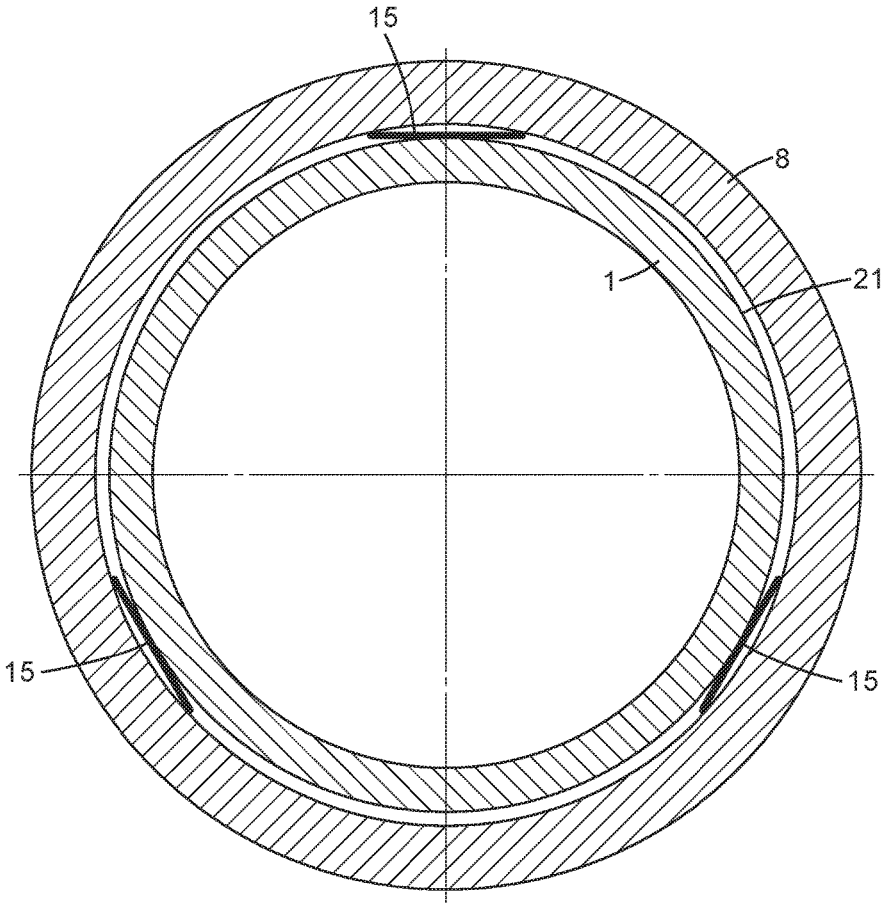
FIG. 10 shows a cross-sectional view of a separating device according to the invention with a first embodiment of the centring bands.
Figure 11:
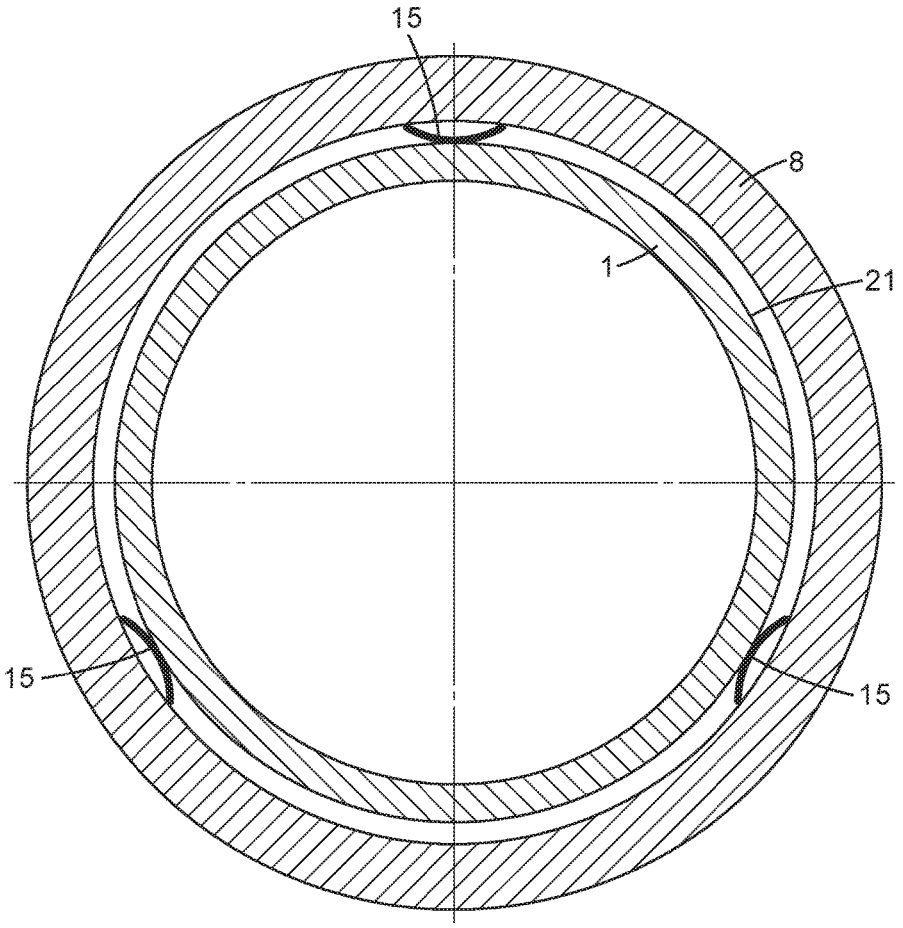
FIG. 11 shows a cross-sectional view of a separating device according to the invention with a second embodiment of the centring bands.

On the outer lateral surface 21 of the basepipe 1, at least three bands 15 are provided axially parallel and uniformly spaced apart (see FIGS. 10 and 11). The annular discs 8 are pushed onto these bands during assembly, whereby centring of the annular discs on the basepipe is achieved. On account of their function, these bands may also be referred to a centring bands. The centring bands are elastically deformable, especially in the radial direction. The centring bands also allow the differences in thermal expansion between the basepipe 1 and the annular stack 7 in the radial direction to be compensated. Moreover, production-related diameter tolerances of the basepipe and the annular discs can also be compensated by the centring bands. The centring of the annular stack on the basepipe also serves the purpose of setting a uniformly wide annular gap between the basepipe and the annular stack. This ensures that the filtrate can flow uniformly through a number of perforation bores into the basepipe.

Preferably, three centring bands are positioned uniformly spaced apart, i.e. respectively at an angle of 120° from one another, on the outer lateral surface of the basepipe. If it is to be expected that the pressure loading of the separating device is very inhomogeneous, it is also possible for more than three centring bands to be provided.

The length of the centring bands corresponds at least to the length of the annular stack, since all of the annular discs of the annular stack including the first and last annular disc are centred.

The centring bands may be of a planar or profiled configuration. The profiling may for example be a curved inward or outward deformation. In FIG. 10, a cross-sectional view of a separating device according to the invention with a planar configuration of the centring bands 15 is shown; FIG. 11 shows a cross-sectional view of a separating device according to the invention with centring bands 15 that are configured with a curvature, the convex side of the curved band being oriented inwards.

The material of the centring bands should preferably be chosen such that it does not corrode under operating conditions and it must be oil-water- and temperature-resistant. Metal or plastic is suitable as the material for the centring bands, preferably metal alloys on the basis of iron, nickel and cobalt, more preferably steel, more preferably spring strip steel. For example, spring strip steel with the material number 1.4310, of a spring-hard configuration, may be used as the material for the centring bands, obtainable for example from COBRA Bandstahl GmbH, D-63607 Wachtersbach. The width of the centring bands may be for example 16 mm and the thickness 0.18 mm.

If steel is used as the material for the centring bands, it must be ensured when selecting the material that it is not conducive to undesired electrochemical reactions occurring on contact with other metallic structural elements of the separating device.

The centring bands may be fastened to the basepipe by screws, rivets, grooved drive studs or adhesive bonding, or by some other customary fastening method. If steel is used as the material for the centring bands, the bands may also be attached to the basepipe by means of welding or spot welding.

The centring bands may be fitted in one or more layers, in order to compensate for diameter tolerances of the basepipe and/or of the annular discs. The thickness and width of the centring bands should be chosen such that the annular discs can be axially displaced on the basepipe with a "sliding fit". This means that, in the vertical position, the annular discs are not axially displaced under their own weight. This is generally the case if the force for displacing the annular discs on the basepipe in the horizontal direction, that is to say without the influence of gravitational force, lies between 0.1 N and 10 N, preferably between 0.5 N and 5 N.

End Caps

At the upper end and the lower end of the annular stack 7 there is in each case an end cap 5, 6 (see FIGS. 1, 3*a*-3*b*, 4*a*-4*b* and 5*a*-5*b*). The end caps are firmly connected to the basepipe. The end caps are produced from metal, usually steel and preferably from the same material as the basepipe. The end caps may be fastened to the basepipe by means of welding, clamping, riveting or screwing. During assembly, the end caps are pushed onto the basepipe after the annular stack and are subsequently fastened on the basepipe. In the embodiments of the separating device according to the invention that are shown in FIGS. 3*a*-3*b*, 4*a*-4*b* and 5*a*-5*b*, the end caps are fastened by means of welding (see the weld seam 20). If the end caps are fastened by means of clamping connections, friction-increasing structural design measures are preferably taken. Friction-increasing coatings or surface structurings may be used for example as friction-increasing measures. The friction-increasing coating may be configured for example as a chemical-nickel layer with incorporated hard material particles, preferably diamond particles. The layer thickness of the nickel layer is in this case for example 10-25 μm; the average size of the hard particles is for example 20-50 μm. The friction-increasing surface structurings may be applied for example as laser structuring.

As already mentioned above, the separating device according to the invention does not have any yielding-elastic structural elements such as springs, rubber discs or other elastic elements that bring about pre-loading. The annular stack of the separating device is not braced by way of compression springs, but is fixed on the basepipe by means of the end caps without the annular stack undergoing any appreciable pre-loading. Dispensing with the compression springs has the effect that tilting of the annular discs cannot occur. The pre-loading in the annular stack in the axial direction must be great enough that annular discs of the annular stack that are not quite planar for production-related reasons are subjected to loading in such a way that all of the spacers are in contact with the planar surface of the adjacent annular disc. The pre-loading in the annular stack in the axial direction in the temperature range of 10° C. to 200° C. is preferably at most 10 MPa, more preferably at most 5 MPa, particularly preferably at most 2 MPa, with respect to the axial projection area of the annular discs. The displacement of the annular discs in the annular stack that is brought about by differences in the liquid pressure during the operation of the separating device in the temperature range of 10° C. to 200° C. is preferably no more than 0.5 per mil in the axial direction, with respect to the length of the annular stack.

Shroud

To protect the brittle-hard annular discs from mechanical damage during handling and fitting into the borehole, the separating device is preferably surrounded by a tubular shroud 4 (see FIG. 1) that can be freely passed through by a flow. This shroud may be configured for example as a coarse-mesh screen and preferably as a perforated plate. The shroud is preferably produced from a metallic material, more preferably from steel, particularly preferably from corrosion-resistant steel. The shroud may be produced from the same material as that used for producing the basepipe.

The shroud is held on both sides by the end caps; it may also be firmly connected to the end caps. This fixing is possible for example by way of adhesive bonding, screwing or pinning; the shroud is preferably welded to the end caps after assembly.

The centring of the annular discs on the basepipe by means of the centring bands also has the effect of ensuring that the annular gap between the inner circumferential surface of the shroud and the outer circumferential surface of the brittle-hard discs is uniform, so that the shroud can perform its protective function better.

The inside diameter of the shroud must be greater than the outside diameter of the annular discs. This is necessary for technical reasons relating to flow. It has been found to be favourable in this respect that the inside diameter of the shroud is at least 0.5 mm and at most 15 mm greater than the outside diameter of the annular discs. The inside diameter of the shroud is preferably at least 1.5 mm and at most 5 mm greater than the outside diameter of the annular discs.

Intermediate Elements

The length of the annular stack of the separating device according to the invention is between 300 and 2000 mm, preferably between 1300 and 1700 mm. In the application concerned, separating devices with lengths of more than 2000 mm are also required. Greater lengths of the separating device can be realized by mounting a number of annular stacks, which are closed off respectively at the top and bottom by an end cap, on a common, continuous basepipe. As an alternative to this, it is also possible for a number of basepipes each with an annular stack that is closed off respectively at the top and bottom by an end cap to be screwed to one another.

Figure 2A:
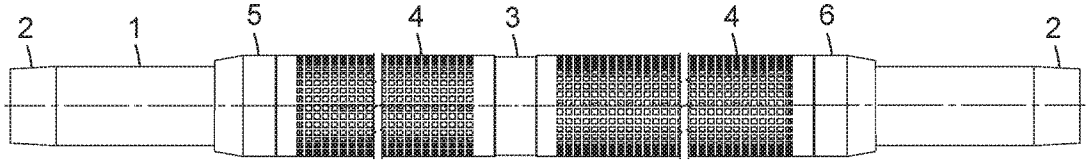
FIGS. 2*a*-2*b* schematically show the overall view of a separating device according to the invention with one intermediate element and with tWOintermediate elements, respectively.
Figure 2B:
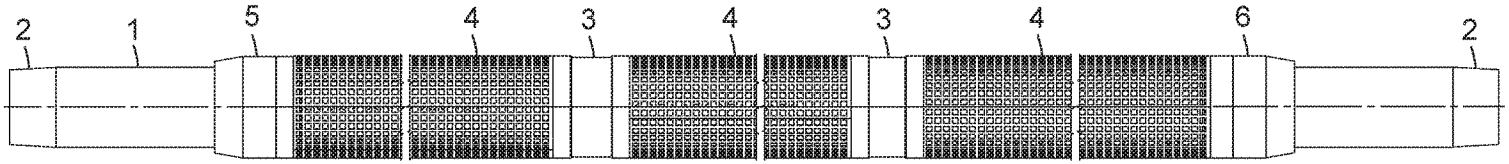

If a number of annular stacks are mounted on a common, continuous basepipe, it is not necessary to fix each annular stack on the basepipe with end caps on both sides. In order to save material and costs, an intermediate element 3 (see FIGS. 2*a* and 2*b*) is placed in each case between tWOadjacent annular stacks and only the first and last annular stack is respectively fixed on one side to an end cap. With an intermediate element, tWOend caps are configured as mirror-symmetrically connected to one another. FIG. 2*a* shows the view of a separating device according to the invention with one intermediate element; FIG. 2*b* shows the view of a separating device according to the invention with tWOintermediate elements.

The configuration with the intermediate element also has the advantage that it is space-saving, whereby more filter area can be accommodated over a given length of the basepipe.

An intermediate element is fixed on the basepipe in the radial and the axial direction, for example by welding, clamping, riveting or screwing.

If the intermediate elements are fastened by means of clamping connections, friction-increasing structural design measures are preferably taken. Friction-increasing coatings or surface structurings may be used for example as friction-increasing measures. The friction-increasing coating may be configured for example as a chemical-nickel layer with incorporated hard material particles, preferably diamond particles. The layer thickness of the nickel layer is in this case for example 10-25 μm; the average size of the hard particles is for example 20-50 μm. The friction-increasing surface structurings may be applied for example as laser structuring.

The intermediate elements are preferably produced from metal, more preferably from steel, particularly preferably from the same material as the basepipe.

Sealing Bushes

At the upper and the lower end of the annular stack 7 there is preferably in each case a sealing bush 16, 17 (see FIGS. 3*a*-3*b*, 4*a*-4*b* and 5*a*-5*b*). The sealing bush has the task of preventing the ingress of liquids and/or gases that are under pressure, for example testing liquid in the test for external pressure resistance (collapse pressure test), into structural cavities, such as for example bevels and gaps, between the end cap and the basepipe or other structural elements such as the compensating bush 22, 23 (see FIGS. 3*a*-3*b*) or the double-wall compensator 24, 25 (see FIGS. 4*a*-4*b*). Otherwise, the liquid under pressure or the gas under pressure could exert a strong axial force on the annular stack over the hydraulically effective annular surface of the uppermost annular disc or over the axial surface of the compensating bush 22, 23 or of the double-wall compensator 24, 25, which could lead to rupturing of the annular discs. An O-ring 19 is incorporated in the sealing bush on its outer circumferential surface. An O-ring may likewise be incorporated on the inner circumferential surface of the sealing bush. The sealing bush with the O-ring seals has the effect of preventing that liquid and/or gas under pressure can get into regions of the separating device that have nothing to do with the filtering function.

During assembly, the sealing bushes 16, 17 are pushed onto the basepipe 1 and are subsequently pushed onto the annular stack 7. Finally, the end cap is pushed over the O-ring 19 of the sealing bush, so that the ingress of liquid and/or gas into regions of the side facing away from the pressure is prevented.

The wall thickness of the sealing bushes 16, 17 on the side that is in contact with the annular stack is preferably equal to the axial wall thickness, that is to say the radial ring width, of the brittle-hard discs.

A wear- and corrosion-resistant material, for example a metallic or ceramic material or else a hard metal, is used as the material for the sealing bushes. The preferred material for the sealing bush is steel. Particularly preferably, the same material as is used for the basepipe is used for the sealing bush.

Compensating Bush

The metallic materials that are used for producing the perforated basepipe, such as for example steel L80, have a greater thermal expansion than the brittle-hard material of the annular discs, such as for example the silicon-carbide ceramic that is preferably used. For steel L80, the coefficient of expansion in the temperature range of 10° C. to 200° C. is about $10.5*10^{-6}$/K; the coefficient of expansion of sintered single-phase silicon carbide (SSiC) in the temperature range of 10° C. to 200° C. is $2.8*10^{-6}$/K. If, at a room temperature of about 20° C., which corresponds to the usual assembly temperature, a multiplicity of ceramic rings were stacked on a steel basepipe without any play and the tWOend caps were welded to the basepipe, the separating device could only be used at temperatures that deviate slightly from the 20° C. mentioned. If the separating device were used at higher temperatures, for example 100° C., the basepipe would axially expand more than the annular stack. As a result, the contact between the rings would no longer be play-free, but rather the distance between the rings could increase, whereby the filter width would change in an undesirable way. When the system cools down, for instance during transport or storage in cold conditions, the basepipe would contract more than the annular stack, which could lead to high compressive stresses in the annular discs and possibly their rupturing.

Various preferred embodiments of the separating device according to the invention in which the different thermal changes in length of the basepipe and the annular stack are compensated are described in more detail.

Figure 12A:
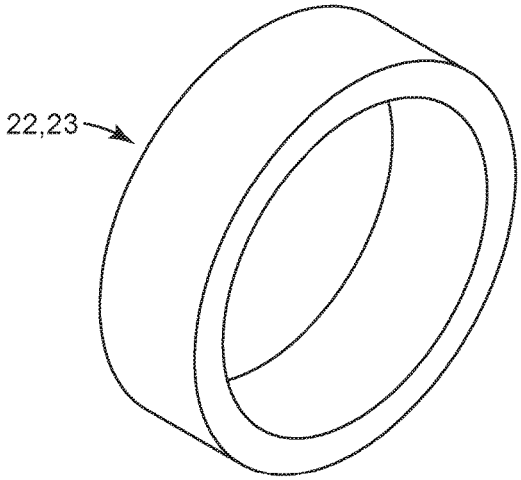
FIGS. 12*a*-12*c* show various views of a compensating element (compensating bush) for the separating device according to the invention of the first preferred embodiment according to FIGS. 3*a*-3*b;*
Figure 12B:
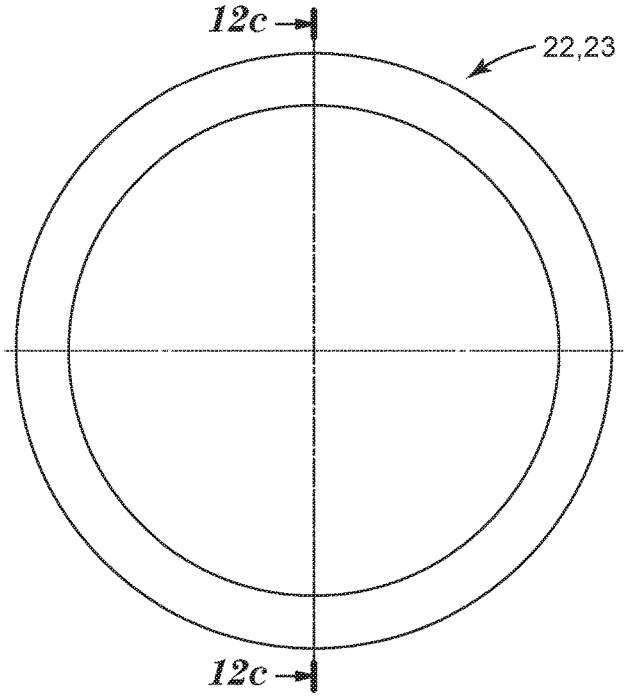
Figure 12C:
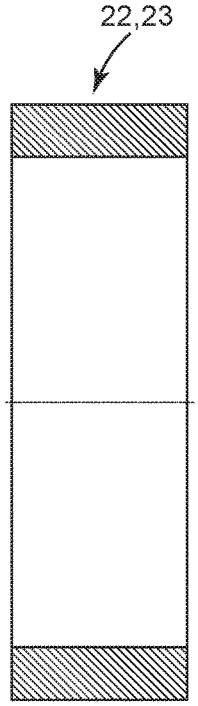

In a first preferred embodiment of the separating device according to the invention (see FIGS. 3*a*-3*b*), at the upper end of the annular stack 7 and/or at the lower end of the annular stack 7, preferably at the lower and the upper end of the annular stack 7, there is a compensating element 22, 23 to compensate for the differing thermal change in length of the basepipe 1 and the annular stack 7. This compensating element is preferably an annular bush of a material with a high coefficient of thermal expansion, the height of which is designed such that it compensates for the differences in the thermal expansion between the perforated basepipe and the annular stack in a temperature range of 10 to 200° C. FIG. 12 shows various views of the compensating bush (FIG. 12*a* shows a 3D view, FIG. 12*b* shows a plan view, FIG. 12*c* shows a cross-sectional view along the sectional line denoted in FIG. 12*b* by "12*c*").

Suitable for the production of the compensating bush are pressure-resistant materials that are oil-, water- and vapour-resistant and do not swell, or only a little. In addition, the materials must be capable of being used at high temperatures (up to about 200° C.) and have a pressure resistance >1 MPa. The coefficient of thermal expansion (CTE) of the material used for the compensating bush should be well above the coefficient of thermal expansion of the material of the brittle-hard annular discs, for example the silicon carbide that is preferably used (CTE of SiC about $2.8*10^{-6}$/K), and the coefficient of thermal expansion of the metallic basepipe (CTE of metals up to about $23*10^{-6}$/K), in order that the compensating bush can be made short. The coefficient of thermal expansion of the material of the compensating bush in the temperature range of 10° C. to 200° C. is preferably around at least $25*10^{-6}$/K, preferably around at least $80*10^{-6}$/K, particularly preferably around at least $100*10^{-6}$/K.

It has been found in the tests that, for the application in the oil and gas industry, especially materials on the basis of PTFE (polytetrafluoroethylene) are particularly suitable as the material for the compensating bush. With regard to the coefficient of thermal expansion and the temperature resistance, PTFE is considerably superior to all other plastics that are so far known. PTFE is distinguished by the combination of a high CTE (CTE of PTFE $120\text{-}190*10^{-6}$/K), a high temperature resistance (can be used up to 250° C.) and chemical resistance. Apart from virgin PTFE, types of PTFE known as modified or filled may also be used. The modification with fillers has the effect that the strength increases and the "cold flow", i.e. the deformation due to creep, is much less. Other plastics, such as for example PEEK (polyether ether ketone), may also be used as the material for the compensating bush. If the separating device is used in an application at low temperatures and there are relatively low requirements for the chemical resistance, lower-cost plastics may also be used for producing the compensating bush.

In the design of the compensating bush, primarily the height of the bush is calculated. The inside diameter of the compensating bush preferably corresponds to the outside diameter of the basepipe; the outside diameter of the compensating bush preferably corresponds to the outside diameter of the annular discs.

The height of the compensating bush $H_K$ is determined according to the following equation:

$$H_K = \Delta L/(\alpha * \Delta T),$$

where $\Delta L$ is the difference in the change in length of the basepipe and the annular stack in the temperature range of the application (for example 10-200° C.)

$\alpha$ is the coefficient of thermal expansion (CTE) of the material of the compensating bush in the temperature range of the application (for example 10-200° C.)

$\Delta T$ is the difference in temperature of the application (for example 190 K with the application range 10-200° C.).

If the compensating bushes are arranged on both sides of the annular stack, the height of the individual bushes is halved to the height ($H_K/2$).

Since the coefficients of thermal expansion that are given in tables for the materials used for the basepipe, the annular stack and the compensating bush generally only represent average values and the coefficient of thermal expansion may be batch-dependent, since it is for example dependent on the grain size, texture, heat treatment and fluctuations in the alloy composition, it may be necessary before designing the compensating bush to determine by means of dilatometer measurements the coefficients of thermal expansion of the materials actually used.

The compensating bush is sufficiently stiff not to be plastically deformed by the axial forces that are caused by differences in pressure occurring during the operation of the separating device. Therefore, even when there are great differences in pressure, the separating device maintains the previously determined filter width, and consequently its full filtering effect. Even under inhomogeneous pressure loading, for example in only one segment of the circumference of the annular stack, tilting of the rings cannot occur.

On the other hand, the compensating bush has a certain yielding compliance, in order that the separating device can undergo any bending that occurs during introduction into the borehole. The material of the compensating bush preferably has a modulus of elasticity of at most 15 000 MPa, more preferably of at most 2000 MPa.

In the case of the embodiment with the compensating bush 22, 23, at both ends of the annular stack there is a sealing bush 16, 17 (see FIGS. 3*a*-3*b*) respectively between the compensating bush and the annular stack. An O-ring 19 is incorporated in the sealing bush on its outer circumferential surface. As previously described, the sealing bush has the task of preventing the ingress of liquids and/or gases that are under pressure into structural cavities, such as for example bevels and gaps, between the end cap and the basepipe and the compensating bush 22, 23 (see FIGS. 3*a*-3*b*). In the case of the embodiment with the compensating bush, the sealing bush 16, 17 assumes the additional function of compensating for the greatly differing yielding compliances of the compensating bush 22, 23 and the brittle-hard annular discs 8, that is to say the function of load distribution. The sealing bush mitigates the difference in stiffness between the compensating bush of a soft material with a low modulus of elasticity and the brittle-hard material of the annular discs with a high modulus of elasticity. For instance, the modulus of elasticity of PTFE is about 700 MPa and that of sintered silicon carbide (SSiC) is about 440 000 MPa. On account of the great difference in the modulus of elasticity, the yielding compliance of the compensating bush is much greater than that of the annular stack. In tests it has proven to be unfavourable to support the annular discs directly on the compensating bush. The annular disc of the annular stack that is adjacent to the compensating bush would not then be sufficiently supported in the event of a local pressure breakthrough and could rupture, and rupturing of further annular discs in the annular stack could also occur. Apart from sealing, the sealing bush placed between the compensating bush and the annular stack also brings about better support of the annular disc closing off the annular stack, so that the annular stack has a greater internal and external pressure resistance. In the case of the embodiment with the compensating bush, the sealing bush must be high enough that it supports the annular discs of the annular stack that close off the annular stack at the top and bottom. This is the case when the axial deformation of the sealing bush remains 0.2 μm under all liquid testing pressures that occur in the test for internal and external pressure resistance (burst and collapse pressure test).

During the assembly of the separating device, the compensating bush 22, 23 is pushed onto the basepipe after the annular stack and the sealing bush. After that, the end cap is pushed over the compensating bush and fastened on the basepipe.

Figure 13A:
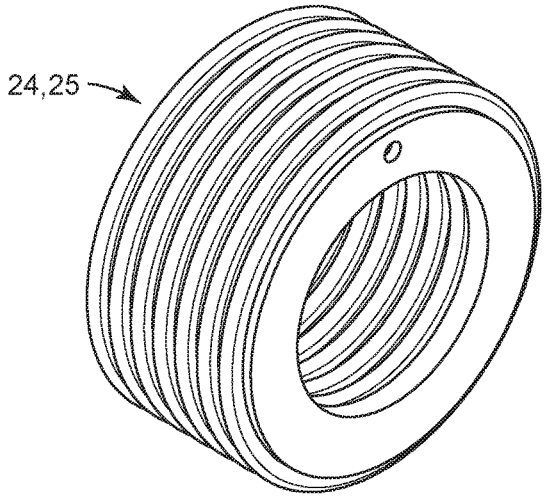
FIGS. 13*a*-13*c* show various views of a compensating element (double-wall compensator) for the separating device according to the invention of the second preferred embodiment according to FIGS. 4*a*-4*b;*
Figure 13B:
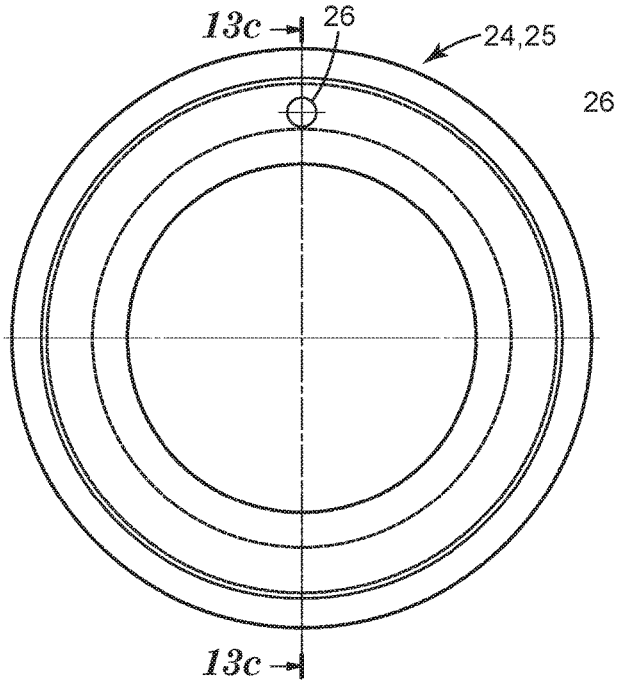
Figure 13C:
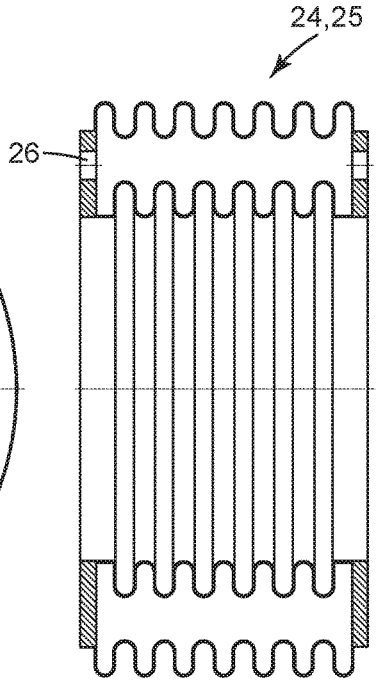

In a second preferred embodiment of the separating device according to the invention (see FIGS. 4*a*-4*b*), at the upper end of the annular stack 7 and/or at the lower end of the annular stack 7, preferably at the lower and the upper end of the annular stack 7, there is a compensating element 24, 25 to compensate for the differing thermal change in length of the basepipe 1 and the annular stack 7. In the case of this embodiment, however, it is not a compensating bush of a material with a high coefficient of thermal expansion that is used as the compensating element, as in the case of the previously described embodiment, but a double-walled container filled with a liquid. The liquid container is tubular. The outer walls of the double-walled liquid container are corrugated in the axial direction, and are therefore formed in such a way that the great thermal volumetric expansion of a liquid is diverted into a linear axial expansion of the liquid container, so that the liquid container has a great thermal linear expansion. In FIGS. 13*a*-13*c*, the structural design of a liquid container that performs this function is represented. The liquid container represented in FIGS. 13*a*-13*c* has the form of a double-walled corrugated-tube sleeve (FIG. 13*a* shows a 3D view, FIG. 13*b* shows a plan view, FIG. 13*c* shows a cross-sectional view along the sectional line denoted in FIG. 13*b* by "13*c*"). On account of its double-walled form, the liquid container is referred to as a double-wall compensator (DWC). Through the filling and venting hole 26, a liquid with great thermal expansion is filled into the double-wall compensator 24, 25 and it is subsequently closed. The height H of the double-wall compensator is designed such that it compensates for the difference in length as a result of the thermal expansion between the annular stack and the basepipe, with the aim of keeping the filter width constant, i.e. maintaining the contact of the annular discs, even when the separating device undergoes heating. A liquid that is suited well for the filling of the double-wall compensator is a mineral oil of great thermal expansion, such as for example diesel oil, the presence of which does not present any problem in the case of oil and gas wells.

The double-wall compensator has the additional advantage over the compensating bush of the previously described embodiment that it has good angular mobility, and therefore improves the flexibility of the separating device as a whole. A separating device with a double-wall compensator can pass through a radius of curvature in the borehole of about 43.7 m, corresponding to a bending of 40°/100 ft or 40°/30.48 m, without the separating device being damaged, which is sometimes required in the case of oil and gas wells. In the case of the embodiment with the compensating bush, bendings of 20°/100 ft or 20°/30.48 m are possible, corresponding to a radius of curvature of 87.3 m.

The double-wall compensator is sufficiently stiff not to be plastically deformed by the axial forces that are caused by differences in pressure occurring during the operation of the separating device. Therefore, even when there are great differences in pressure, the separating device maintains the previously determined filter width, and consequently its full filtering effect. Even under inhomogeneous pressure loading, for example in only one segment of the circumference of the annular stack, tilting of the rings cannot occur. On the other hand, the double-wall compensator has a certain yielding compliance, in order that the separating device can undergo any bending that occurs during introduction into the borehole.

In the case of the embodiment with the double-wall compensator 24, 25, at both ends of the annular stack there is preferably a sealing bush 16, 17 (see FIGS. 4*a*-4*b*) respectively between the double-wall compensator and the annular stack. An O-ring 19 is incorporated in the sealing bush on its outer circumferential surface. As previously described, the sealing bush has the task of preventing the ingress of liquids and/or gases that are under pressure into structural cavities, such as for example bevels and gaps, between the end cap and the basepipe and the double-wall compensator 24, 25. During the assembly of the separating device, the double-wall compensator 24, 25 is pushed onto the basepipe after the annular stack and the sealing bush. After that, the end cap is pushed over the liquid container and fastened on the basepipe.

Figure 5A:
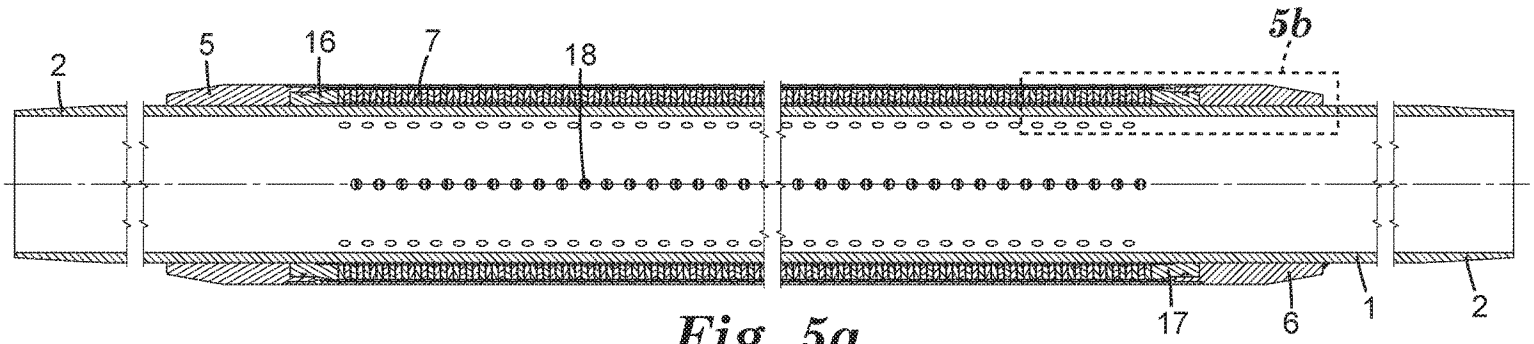
FIGS. 5*a*-5*b* show a cross-sectional view of a separating device according to the invention according to a third preferred embodiment and a fourth preferred embodiment.
Figure 5B:
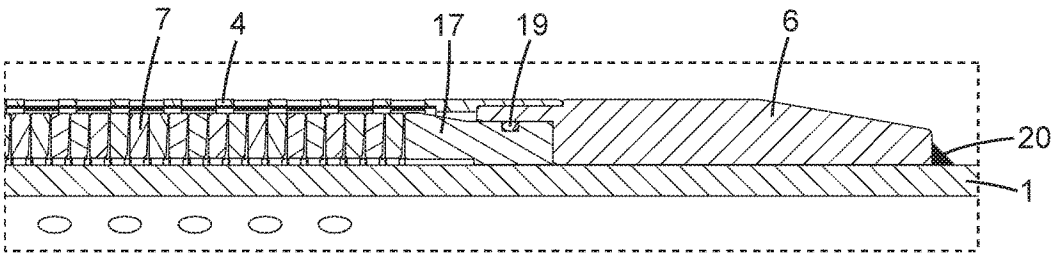

FIGS. 5*a* and 5*b* show the cross-sectional view of a separating device according to the invention according to a third and fourth preferred embodiment.

In a third preferred embodiment of the separating device according to the invention (see FIGS. 5*a*-5*b*), a metallic material of which the coefficient of thermal expansion comes close to that of the annular discs is used as the material for the basepipe 1. This means that the basepipe is produced from a material of which the coefficient of thermal expansion in the temperature range of 10° C. to 200° C. deviates from the coefficient of thermal expansion of the material of the annular stack in the temperature range of 10° C. to 200° C. by at most 10%, preferably by at most 5%.

Such material may be for example the iron-nickel alloy Fe36Ni with the material number 1.3912, which is known by the trade name Invar. Other trade names are Nilo alloy 36, Nilvar, NS 36, Permalloy D, Radio metal 36, Vacodil 36 and Pernifer 36. The coefficient of thermal expansion of this material is $2.6*10^{-6}$/K and, in the temperature range of 10° C. to 200° C., matches well with the coefficient of thermal expansion of the material of the annular discs, for example the silicon-carbide ceramics that are preferably used. The coefficient of thermal expansion of this material can be set by way of the alloy composition and can be adapted to the material that is used for the annular stack. In the case of this embodiment, in which the coefficient of thermal expansion of the material of the basepipe is adapted to that of the material of the annular stack, no further length-compensating measures are necessary because of differing coefficients of thermal expansion of the basepipe and the annular stack. Consequently, in the case of this embodiment it is possible to dispense with a separate compensating element, such as for example the compensating bush or the double-wall compensator. However, it is also possible to use additional compensating elements. In the case of this embodiment, at the upper and the lower end of the annular stack there are preferably sealing bushes 16, 17 (see FIGS. 5*a*-5*b*). An O-ring 19 is incorporated in the sealing bush on its outer circumferential surface. The sealing bushes 16, 17 are pushed onto the basepipe 1 after the annular stack 7 and subsequently end caps 5, 6 are pushed onto the basepipe 1 and fastened to the basepipe.

For example, the separating device according to the invention according to the third embodiment (see FIGS. 5*a*-5*b*) may be configured with an annular stack 7 of silicon-carbide ceramic and a basepipe 1 of Pernifer 36. Tests in a climatically controlled chamber with a separating device constructed in such a way have shown that, in the range of 10° C. to 200° C., neither undesired widenings of the filter gaps between the ceramic rings occur nor do the ceramic rings rupture as a result of excessive compressive stresses in the rings.

In a fourth preferred embodiment (see FIGS. 5*a*-5*b*) of the separating device according to the invention, a ceramic material on the basis of zirconium dioxide ($ZrO_2$) is used as the material for the annular discs. The coefficient of thermal expansion of zirconium-dioxide ceramics is similar to the coefficient of thermal expansion of the grades of steel that are usually used for the basepipe. The coefficient of thermal expansion of the zirconium-dioxide ceramic in the temperature range of 10° C. to 200° C. preferably deviates from the coefficient of thermal expansion of the material of the basepipe in a temperature range from 10° C. to 200° C. by at most 10%, more preferably by at most 5%. In the case of this embodiment, in which the coefficient of thermal expansion of the material of the annular stack 7 is adapted to that of the material of the basepipe 1, no further length-compensating measures are necessary because of differing coefficients of thermal expansion of the basepipe and the annular stack. Consequently, in the case of this embodiment it is possible to dispense with a separate compensating element, such as for example the compensating bush or the double-wall compensator. However, it is also possible to use additional compensating elements. In the case of this embodiment, at the upper and the lower end of the annular stack there are preferably sealing bushes 16, 17 (see FIGS. 5*a*-5*b*). An O-ring 19 is incorporated in the sealing bush on its outer circumferential surface. The sealing bushes 16, 17 are pushed onto the basepipe 1 after the annular stack 7 and subsequently end caps 5, 6 are pushed onto the basepipe 1 and fastened to the basepipe.

In a further embodiment of the separating device according to the invention, the annular stack is constructed from annular discs that are produced from different brittle-hard materials. For example, annular discs of silicon-carbide ceramic and of zirconium-dioxide ceramic may be stacked alternately one on top of the other. The number of annular discs of the different materials is in this case chosen such that the annular stack as a whole has a thermal expansion that corresponds to that of the basepipe. A material that is correspondingly adapted with regard to the coefficient of thermal expansion, for example an iron-nickel alloy, is preferably used in this case as the material for the basepipe.

Figure 14A:
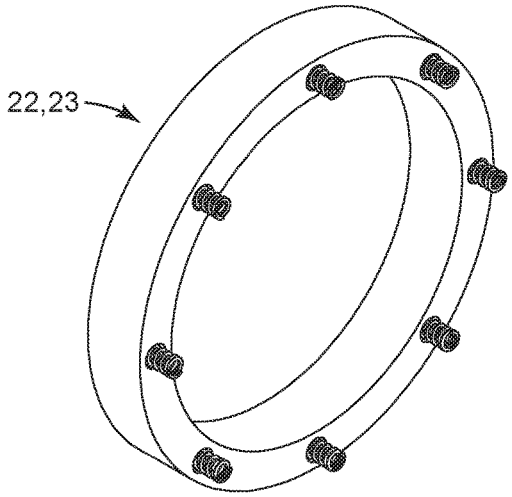
FIGS. 14*a*-14*c* show various views of a compensating bush with spiral springs for the separating device according to the invention of the first preferred embodiment according to FIGS. 3*a*-3*b;*
Figure 14B:
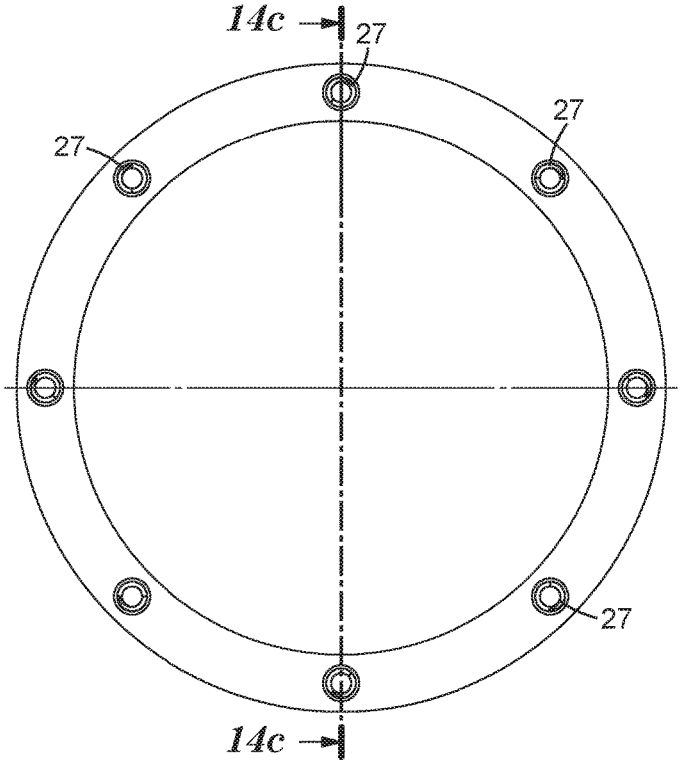
Figure 14C:
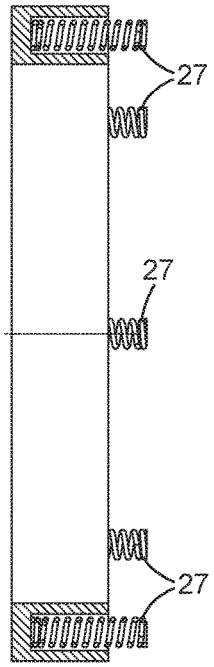
Figure 15A:
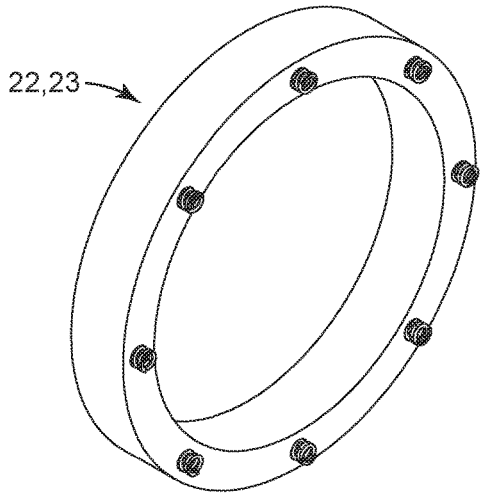
FIGS. 15*a*-15*c* show various views of a compensating bush with spiral springs for the separating device according to the invention of the first preferred embodiment according to FIGS. 3*a*-3*b;*
Figure 15B:
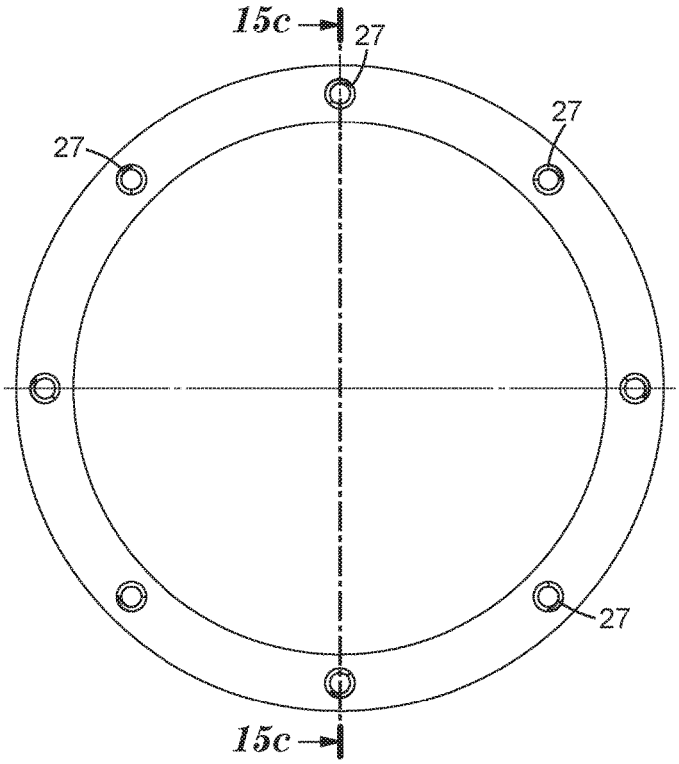
Figure 15C:
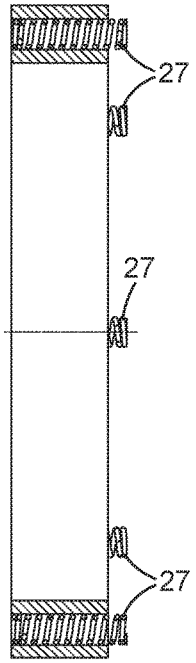

In a further embodiment of the separating device according to the invention according to FIG. 3, provided in the upper and/or lower compensating bush 22, 23 are bores, which are distributed uniformly over the circular circumference and into which the spiral springs 27 are inserted (see FIGS. 14*a*-14*c* and 15*a*-15*c*). The spiral springs are pressed against the sealing bush 16, 17. 3 to 12, preferably 6 to 9 and particularly preferably 8 spiral springs are used. The bores may be configured as blind-hole bores (see Block of FIG. 14; FIG. 14*a* shows a 3D view, FIG. 14*b* shows a plan view, FIG. 14*c* shows a cross-sectional view along the sectional line denoted in FIG. 14*b* by "14*c*") or else as continuous bores (see Block of FIG. 15; FIG. 15*a* shows a 3D view, FIG. 15*b* shows a plan view, FIG. 15*c* shows a cross-sectional view along the sectional line denoted in FIG. 15*b* by "15*c*").

The spring constant of the spiral springs may be for example 10 N/mm. The spiral springs are prestressed, in that they are compressed to the depth of the bore, so that the spiral springs finish flush with the planar side of the compensating bush. The depth of the bores is chosen such that the spiral springs in the prestressed state bring about a total force of at least 500 N.

If, for example, 8 spiral springs with a length of 25 mm and a diameter of 7.5 mm are used, each spring should produce a force of 62.5 N (=500 N/8). With a spring constant of 10 N/mm, for this the spring must be prestressed to 18.75 mm (=25−6.25 mm). The bores that are incorporated in the compensating bush for the spiral springs must therefore be 18.75 mm deep. 8.0 mm is chosen here as the diameter for the bores.

In order to avoid a local stress peak on the standing area of the spring, in the case of the configuration with blind-hole bores on the base of the bore, which is planar at the bottom, there is placed a metal disc of a thickness ≥2 mm, the thickness of which must also be included when calculating the depth of the bore.

In comparison with the compression springs that are used in the prior art for bracing the annular stack, there is the advantage with the spiral springs recessed in the compensating bush that the springs can only expand over a certain distance, but by support or abutment on the compensating bush it is prevented that the springs can be compressed. Therefore, a liquid pressure acting from the inside or the outside also cannot push the rings apart, as is possible in the case of the compression springs for bracing the annular stack.

The spiral springs incorporated in the compensating bush bring about an additional compensation of the different changes in length of the annular stack 7 and the basepipe 1. In the temperature range of +15° C. to −30° C., it is ensured by the spiral springs incorporated in the compensating bush that the annular discs in the annular stack are play-free, and consequently cannot "rattle".

In an alternative embodiment of the separating device according to the invention, the annular stack is constructed from tWOdifferently formed annular discs, which are stacked alternately. The first form of the annular discs here has on both sides spacers with a planar contact area; the second form of the annular discs comprises simple rings that are planar on both sides and have the same inside diameter and outside diameter as in the case of the first form. The upper side and underside of the second form of the annular discs is formed as smooth and planar and at right angles to the disc axis. The spacers on the first form of the annular discs are respectively formed identically on their upper side and underside. The number, type, arrangement and dimensions of the spacers on the annular discs of the first form are chosen here such that they correspond to the number, type, arrangement and dimensions in the case of one of the embodiments presented above. The configuration of the upper side and underside of the annular discs of the first form corresponds in the regions between the spacers to the configuration of the upper side of the annular discs in the case of one of the embodiments presented above, i.e. the upper side and underside of the annular discs of the first form is preferably inwardly or outwardly sloping in the regions between the spacers. Particularly preferably, the upper side and underside of the annular discs are inwardly sloping in the regions between the spacers. The lowermost and the uppermost of the annular discs of the annular stack are in this case preferably worked from the second form, i.e. they are rings that are planar on both sides, without spacers.

The alternative embodiment of the separating device according to the invention consequently comprises the following basic elements that are designed appropriately for the materials and made to match one another:

- an annular stack 32 (see FIGS. 17*a*-17*f*) of at least three brittle-hard annular discs, the upper side 29 and the underside 30 of every second annular disc 28 (see FIGS. 16*a*-16*g*) in the annular stack having at least three spacers 10 distributed uniformly over the circular circumference of the discs. The respectively adjacent annular discs 31 do not have any spacers, but are planar on both sides. The contact area 11 of the spacers is planar, so that the spacers 10 have planiform contact with the adjacent annular disc 31. The annular discs are stacked and fixed in such a way that a separating gap 14 (see FIGS. 17*b* and 17*d*) for removing solid particles is respectively formed between the individual discs. The axial projection of the annular discs at the inner and the outer circumference is circular. The annular discs therefore do not have any strength-reducing grooves or clearances on their inner and outer circumferential surfaces. The circular shape, which is ideal from a structural design viewpoint, has the effect that concentrations of stress as a result of pressure loading are largely avoided. The material of the annular discs, both those with spacers on both sides and those without spacers, corresponds to the brittle-hard material such as is used for the previously described embodiments of the separating device according to the invention;
- a perforated pipe 1 located inside the annular stack 32 (see FIGS. 1, 2*a*-2*b*, 3*a*-3*b*, 4*a*-4*b* and 5*a*-5*b*), on which the brittle-hard annular discs are stacked. The perforated pipe located inside the annular stack is also referred to as the basepipe;
- at least three bands 15 (see FIGS. 10 and 11), which are provided axially parallel and uniformly spaced apart on the lateral surface of the perforated pipe 1 (basepipe) located inside the annular stack 32, onto which the annular discs have been pushed, whereby the annular discs are centred on the perforated pipe; and
- tWOend caps 5, 6 at the upper and lower ends of the annular stack 32 (see FIGS. 1, 2*a*-2*b*, 3*a*-3*b*, 4*a*-4*b* and 5*a*-5*b*), the end caps 5, 6 being firmly connected to the perforated pipe 1.

In FIGS. 3*a*-3*b*, 4*a*-4*b* and 5*a*-5*b*, the separating device according to the invention with the annular stack 7 is represented; in the alternative embodiment of the separating device, the annular stack 7 is replaced by the annular stack 32, represented in FIGS. 3*a*-3*b*, 4*a*-4*b* and 5*a*-5*b*. All of the other structural elements remain unchanged.

Figure 16A:
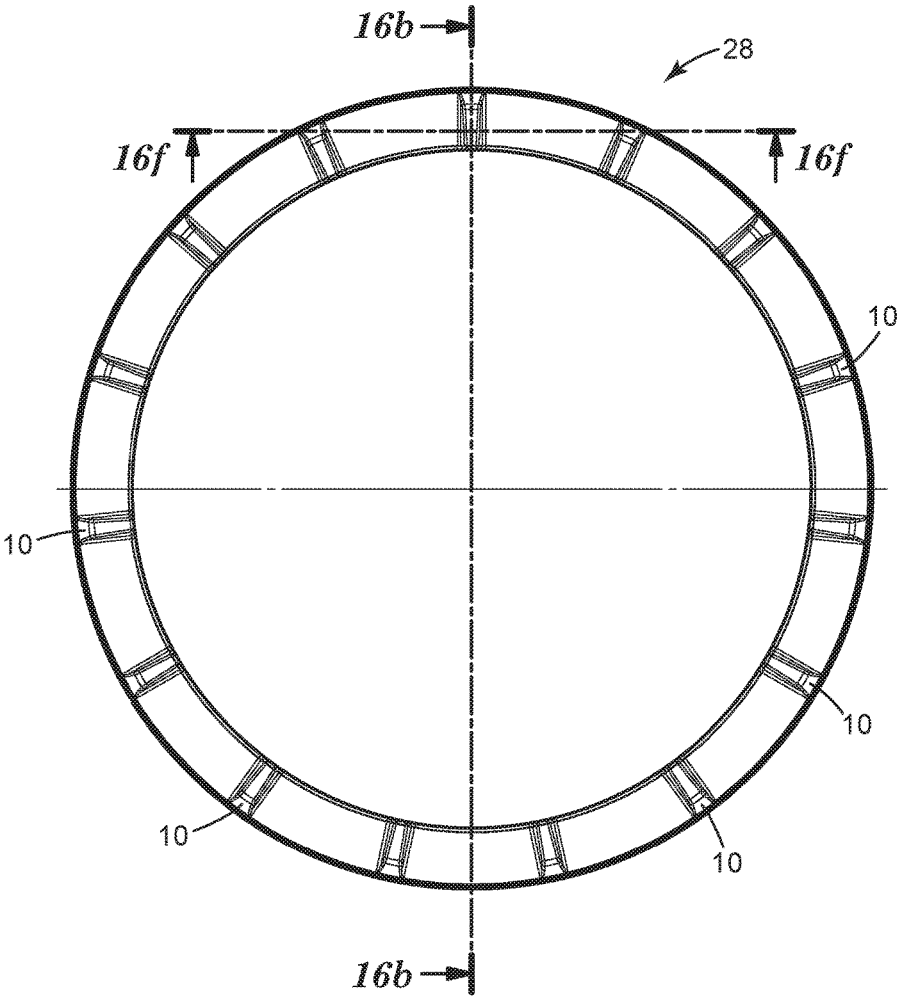
FIGS. 16*a*-16*g* show various views of an annular disc according to the invention within 15 spacers respectively on the upper side and underside of the annular disc.
Figure 16B:
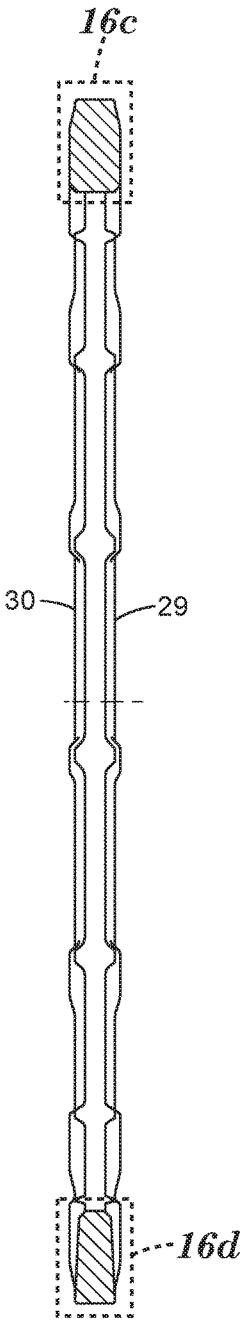
Figure 16C:
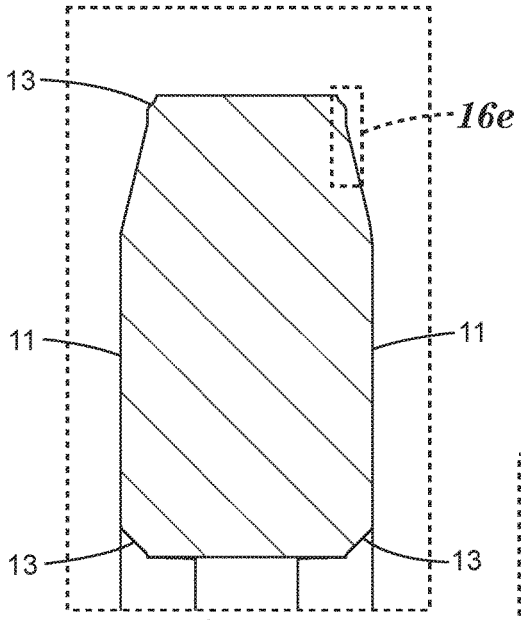
Figure 16E:
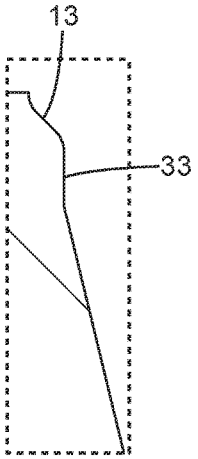
Figure 16D:
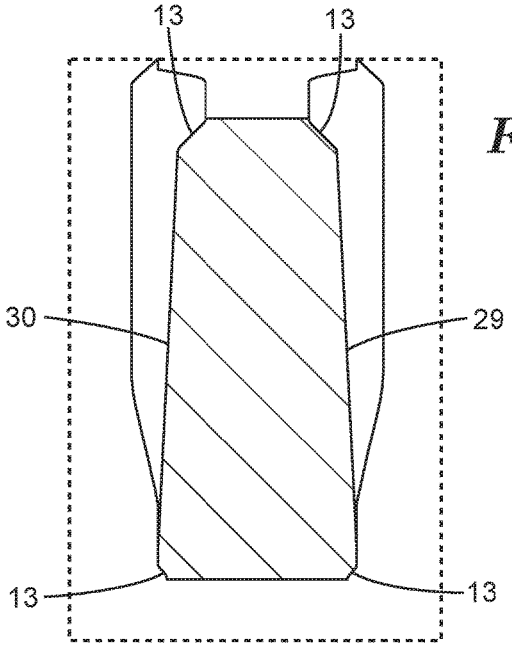
Figure 16F:
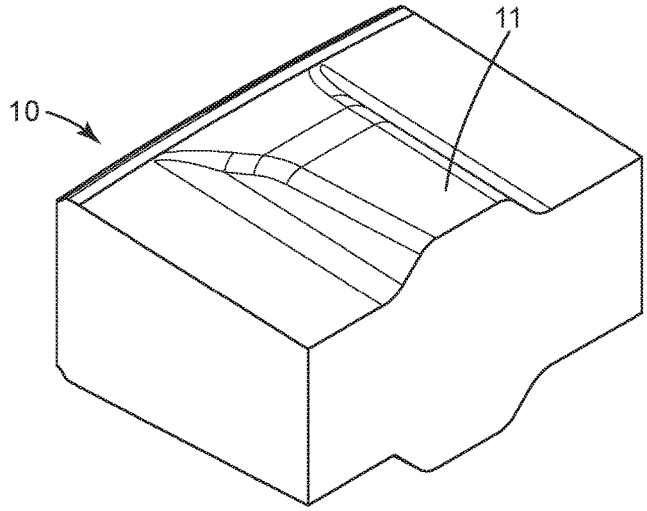
Figure 16G:
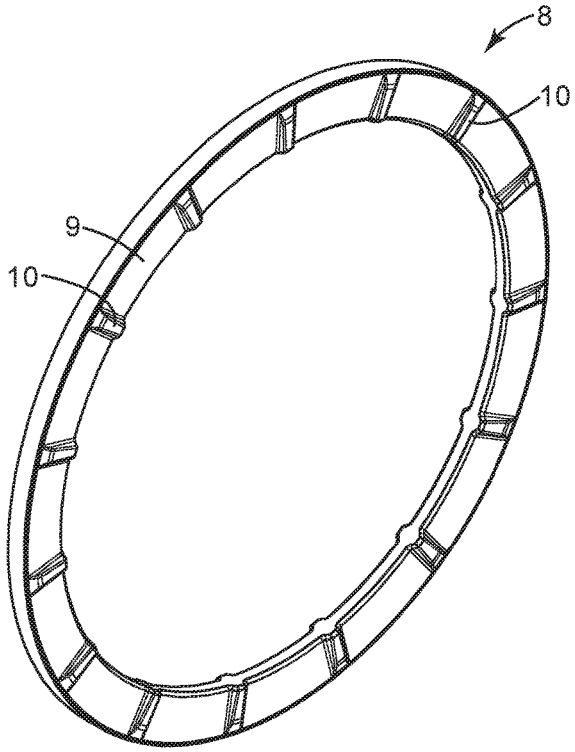
Figure 17A:
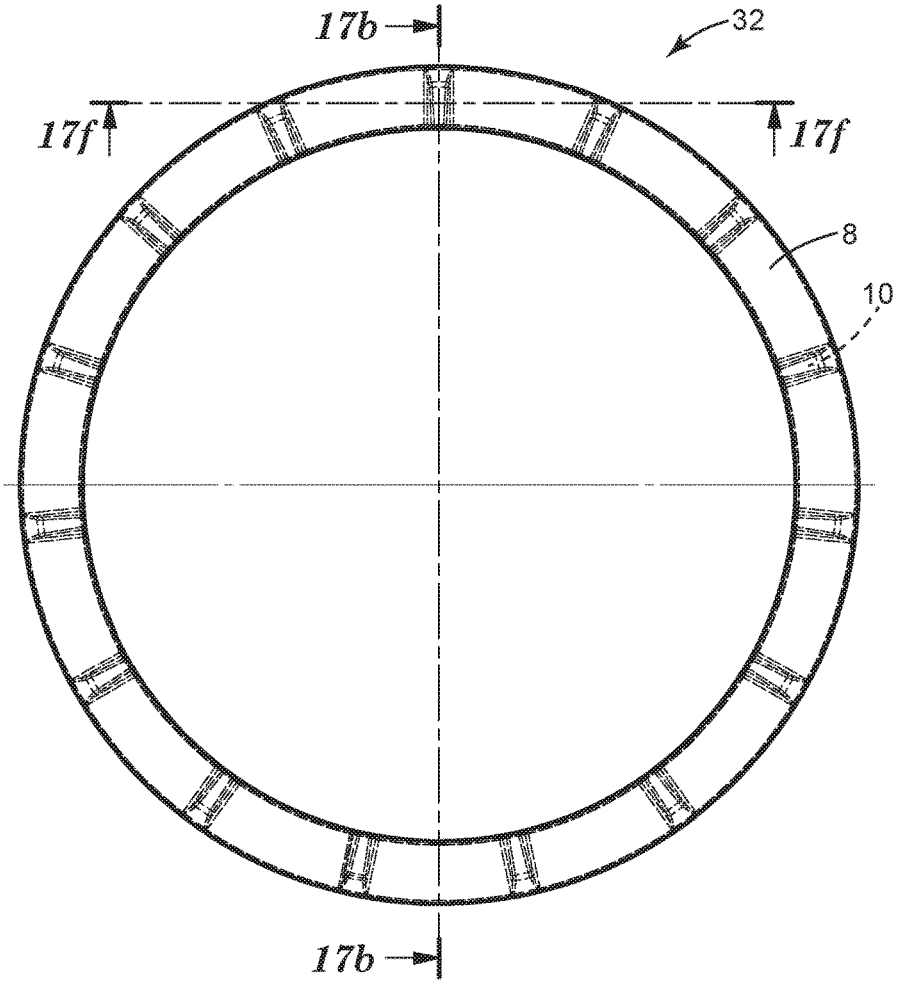
FIGS. 17*a*-17*f* schematically show various views of an annular stack with annular discs according to FIGS. 16*a*-16*g*.
Figure 17B:
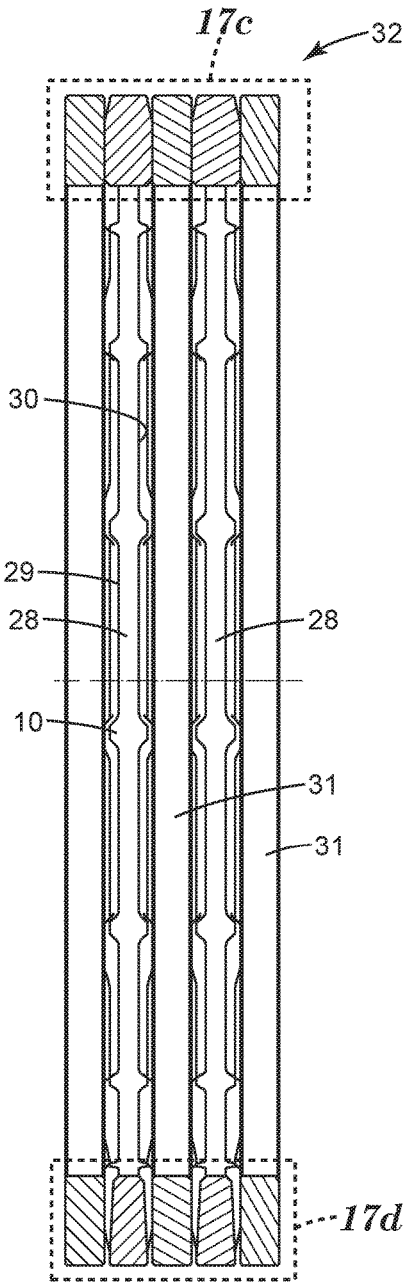
Figure 17C:
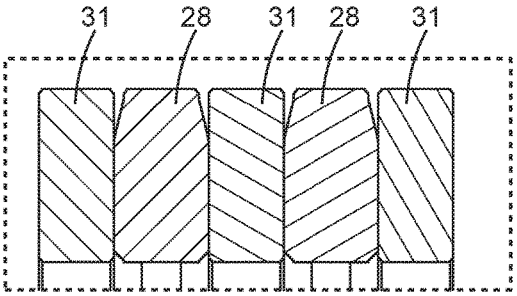
Figure 17D:
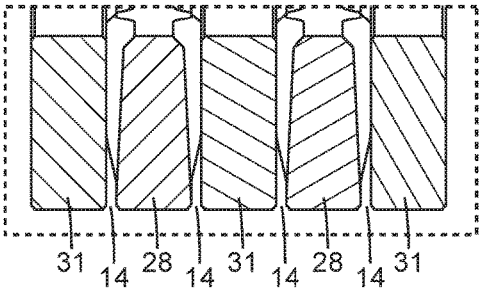
Figure 17E:
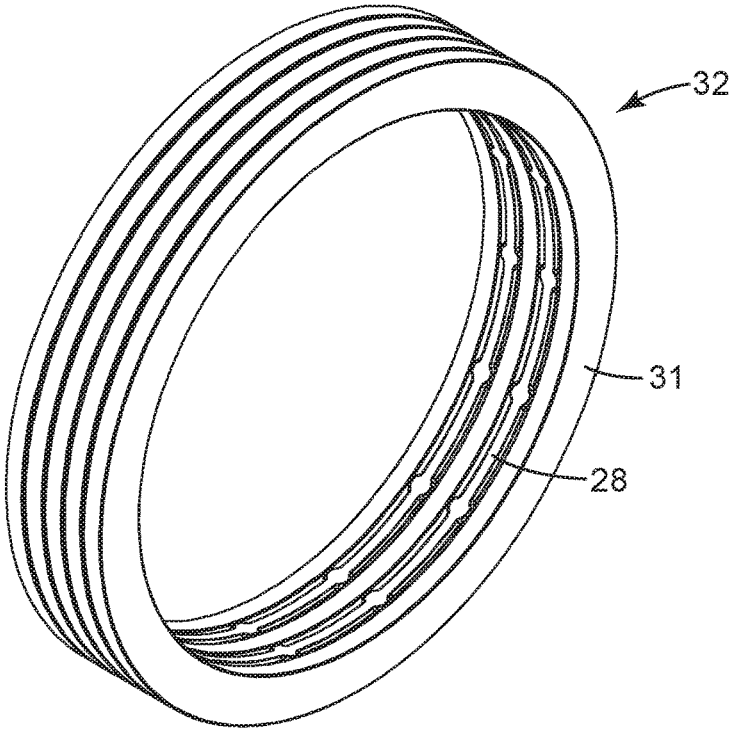

FIG. 16*a* shows a plan view of an annular disc 28 with 15 spacers on the upper side and underside, which in the annular stack 32 are stacked respectively as every second annular disc, alternating with the annular discs 31. FIG. 16*b* shows a cross-sectional view along the sectional line denoted in FIG. 16*a* by "16*b*"; FIGS. 16*c*-16*e* show enlarged details of the cross-sectional view of FIG. 16*b*. FIG. 16*f* shows a 3D representation along the sectional line denoted in FIG. 16*a* by "16*f*"; FIG. 16*g* shows a 3D view of the annular disc. FIGS. 17*a*-17*f* schematically show an annular stack 32 constructed from annular discs 28 of FIGS. 16*a*-16*g* and also from annular discs 31. FIG. 7 a shows a plan view of the annular stack; FIG. 7*b* shows a cross-sectional view along the sectional line denoted in FIG. 7*a* by "7*b*". FIGS. 7*c* and 7*d* show enlarged details of the cross-sectional view from FIG. 7*b*. FIG. 7*e* shows a 3D view of the annular stack; FIG. 7*f* shows a 3D representation along the sectional line denoted in FIG. 7*a* by "7*f*".

Apart from the fact that in the case of the alternative embodiment tWOdifferent forms of brittle-hard annular discs 28, 31 are alternately stacked, the further details of this embodiment correspond to those of the previously described embodiments, that is to say for example the dimensions of the brittle-hard annular discs 28, 31, the design of the basepipe 1, of the centring bands 15, of the sealing bushes 16, 17 and of the end caps 5, 6. As already stated, the dimensions, design, number and arrangement of the spacers 10 corresponds to the dimensions, the design, number and arrangement of the spacers in the case of the embodiments presented above. The design of the upper side and underside 29, 30 of the first form of the annular discs 28 with the spacers on the upper side and underside (see FIGS. 16*a*-16*g*) corresponds in the regions between the spacers (see FIG. 16*d*) to the design of the upper side of the annular discs in the case of the embodiment with spacers only on the upper side, i.e. the upper side and underside 29, 30 of the first form of the annular discs 28 with the spacers on the upper side and underside is inwardly or outwardly sloping, preferably inwardly sloping.

Figure 17F:
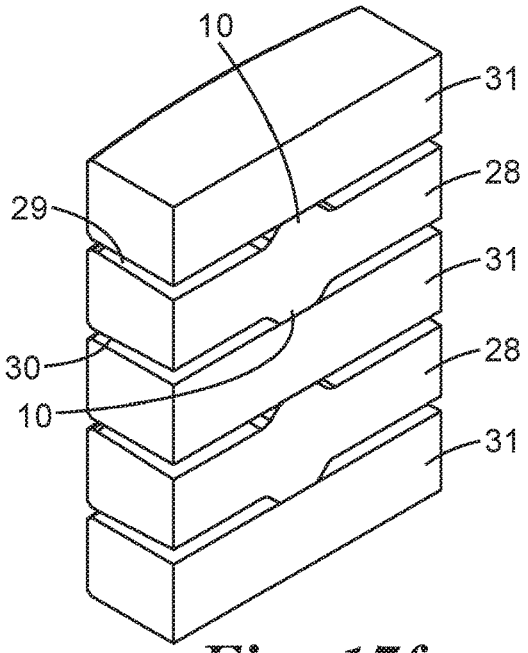

Also in the case of this embodiment, the annular discs may be stacked one on top of the other in any desired or random orientation; however, it is also possible in the case of this embodiment to position the spacers in the annular stack respectively in line one over the other, as represented in FIG. 17*f*. Also in the case of this embodiment, as described above, intermediate elements may be used. The combination of this alternative embodiment with all of the embodiments described above is likewise possible. Thus, for example, as described above, compensating elements may be used to compensate for the differing thermal change in length of the basepipe and the annular stack, such as for example compensating bushes or double-wall compensators at the upper end and/or at the lower end of the annular stack. It is also possible in the case of this alternative embodiment of the separating device according to the invention to use as the material for the basepipe a metallic material of which the coefficient of thermal expansion comes close to that of the annular discs. It is similarly possible to use as the material for the annular discs a ceramic material on the basis of zirconium dioxide ($ZrO_2$).

This alternative is comparable in the filtering effect to the embodiments described above, but is accompanied by the advantages in the production of the annular discs. It is favourable for the facing of the annular discs on both sides by lapping if the surfaces to be removed on the upper side and underside are the same size, since then the removal by lapping is the same on both sides and the height of the flat-formed spacers can be exactly controlled more easily. If the surfaces to be removed on the upper side and underside are different, there is an unsymmetrical removal of material, which is consequently more difficult to control. The same also applies correspondingly to the annular discs that are planar on both sides. This form of ring is easier to work, and any thickness tolerances of the annular discs that may occur have no effect on the absolute size of the filter width. In the case of this embodiment of the separating device, consequently still closer tolerances can be set for the filter width.

The separating device according to the invention is used in extraction wells in oil and/or gas reservoirs for separating solid particles from volumetric flows of mineral oil and/or natural gas. The separating device may also be used for other filtering processes for removing solid particles from liquids and/or gases outside of extraction wells, processes in which a great abrasion resistance and a long lifetime of the separating device are required, such as for example for filtering processes in mobile and stationary storage installations for liquids and/or gases or for filtering processes in naturally occurring bodies of water, such as for instance in the filtering of seawater. The separating device according to the invention is particularly suitable for the separation of solid particles from liquids or gases, in particular from mineral oil, natural gas and water, in extraction wells in which high and extremely high rates of flow and delivery volumes, and consequently high differences in pressure, occur between the inflow side and the outflow side of the separating device.

EXAMPLES

Example 1: Calculation of the Height of the Compensating Bush

Figure 3A:
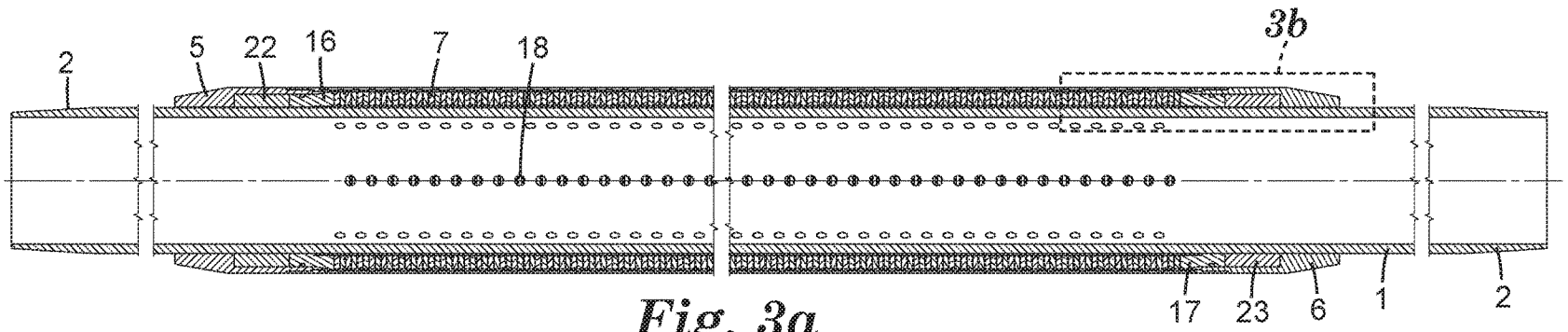
FIGS. 3*a*-3*b* show a cross-sectional view of a separating device according to the invention according to a first preferred embodiment.
Figure 3B:
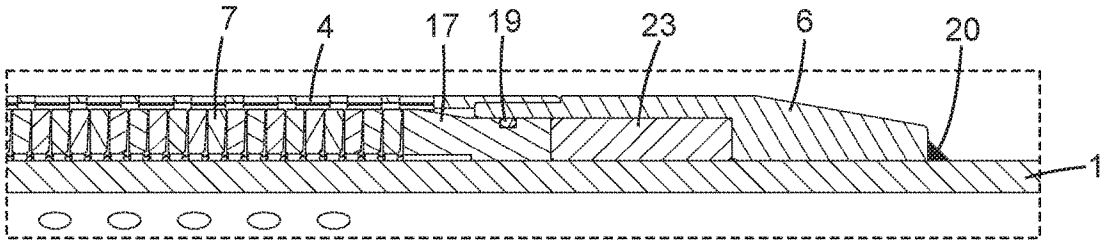
Figure 4A:
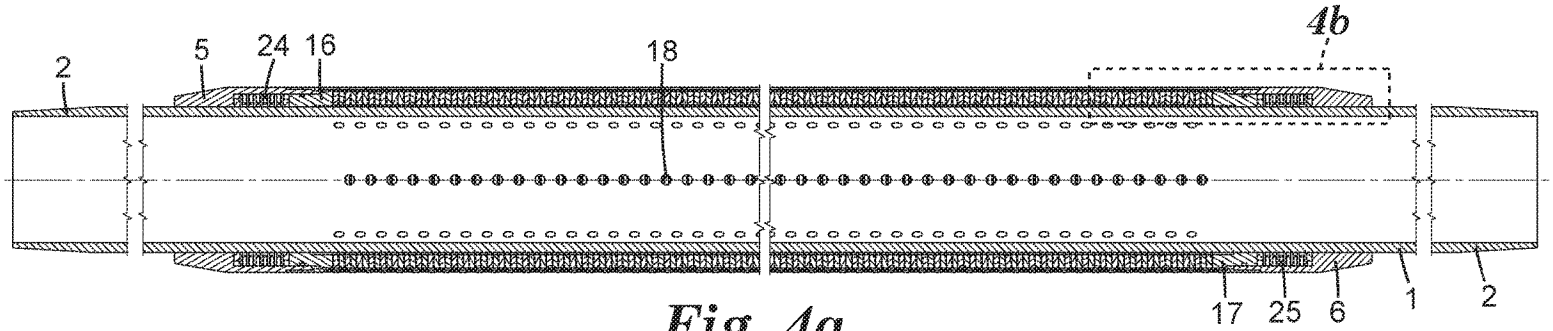
FIGS. 4*a*-4*b* show a cross-sectional view of a separating device according to the invention according to a second preferred embodiment.
Figure 4B:
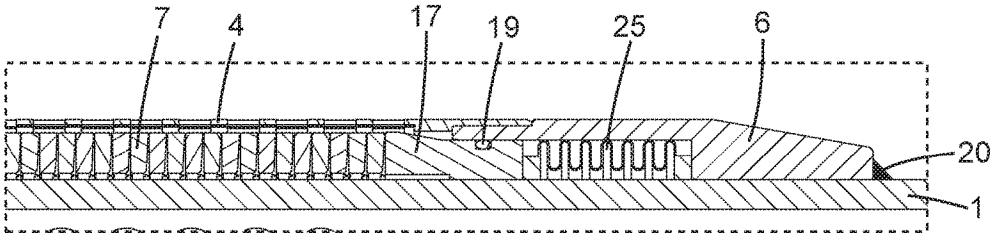

A separating device according to the invention according to FIGS. 3*a*-3*b* is inserted into a borehole. At the place where the separating device is inserted, a temperature of 150° C. prevails. Steel L80 is used as the material for the basepipe. Sintered silicon carbide (SSiC; 3M™ silicon carbide type F, ESK Ceramics GmbH & Co. KG) is used as the material for the annular stack. To compensate for the differing thermal expansion of the basepipe and the annular stack, a compensating bush of PTFE (polytetrafluoroethylene) is used at one or both ends of the annular stack. The PTFE compensating bush has the effect of preventing gaps that are greater than the desired filter width from forming between the annular discs at the higher temperatures at the place where it is inserted.

The height $H_K$ of the compensating bush of PTFE is calculated according to the equation $$H_K = \Delta L/(\alpha * \Delta T),$$

where $\Delta L$ is the difference in the change in length of the basepipe and the annular stack in the temperature range of the application (here 20-150° C.)

$\alpha$ is the coefficient of thermal expansion (CTE) of the material of the compensating bush in the temperature range of the application (here 20-150° C.)

$\Delta T$ is the difference in temperature of the application (here 130 K with the application range 20-150° C.).

The height of the annular stack is 1000 mm. The coefficient of thermal expansion $\alpha_{steel}$ of the steel L80 used for the basepipe is $10.5*10^{-6}$/K; the linear expansion of the basepipe $\Delta L_{basepipe}$ of steel in the temperature range of 20 to 150° C. (according to $\Delta L_{basepipe}=L_{basepipe}*\alpha_{steel}*\Delta T$) is 1000 mm*10.5*$10^{-6}$/K*130 K, consequently 1.36 mm. The coefficient of thermal expansion $\alpha_{SSiC}$ of the SSiC material used for the annular stack is 2.8*$10^{-6}$/K; the linear expansion of the annular stack of silicon carbide $\Delta L_{annularstack}$ in the temperature range of 20 to 150° C. (according to $\Delta L_{annularstack}=L_{annularstack}*\alpha_{SSiC}*\Delta T$) is 1000 mm*2.8*$10^{-6}$/K*130 K, consequently 0.36 mm. The difference in the linear expansion of the annular stack and the basepipe is consequently 1.36 mm-0.36 mm=1.00 mm. In order to guide the annular discs axially without any play, the compensating bush of PTFE must have a linear expansion of 1.00 mm.

The coefficient of thermal expansion α of PTFE is 125*$10^{-6}$/K. The height of the PTFE compensating bush can consequently be calculated according to the equation $H_K=\Delta L/(\alpha*\Delta T)$ as 1.00 mm/(125*$10^{-6}$/K*130 K), consequently 61.54 mm. A PTFE compensating bush that expands when ΔT=130 K by 1.00 mm must consequently have a height $H_K$ of 61.54 mm. If the PTFE compensating bushes are arranged at both ends of the annular stack, the height is halved to 30.77 mm.

Example 2: Calculation of the Height of the Compensating Bush

A separating device according to the invention according to FIGS. 3*a*-3*b* is used at a temperature of 200° C. The height of the annular stack is 1500 mm. Steel 1.4563 (Incoloy® Alloy 028) is used as the material for the basepipe. Sintered silicon carbide (SSiC; 3M™ silicon carbide type F, ESK Ceramics GmbH & Co. KG) is used as the material for the annular stack. The coefficient of thermal expansion $\alpha_{steel}$ of the material used for the basepipe is 15.2*$10^{-6}$/K; the linear expansion of the basepipe $\Delta L_{basepipe}$ in the temperature range of 20 to 200° C. (according to $\Delta L_{basepipe}=L_{basepipe}*\alpha_{steel}*\Delta T$) is 1500 mm*15.2*$10^{-6}$/K*180 K, consequently 4.1 mm. The coefficient of thermal expansion $\alpha_{SSiC}$ of the SSiC material used for the annular stack is 2.8*$10^{-6}$/K; the linear expansion of the annular stack of silicon carbide $\Delta L_{annularstack}$ in the temperature range of 20 to 200° C. (according to $\Delta L_{annularstack}=L_{annularstack}*\alpha_{SSiC}*\Delta T$) is 1500 mm*2.8*$10^{-6}$/K*180 K, consequently 0.76 mm. The difference in the linear expansion of the annular stack and the basepipe is consequently 3.34 mm. In order to guide the annular discs axially without any play, the compensating bush of PTFE must have a linear expansion of 3.34 mm.

The coefficient of thermal expansion α of PTFE is 125*$10^{-6}$/K. The height of the PTFE compensating bush can consequently be calculated according to the equation $H_K=\Delta L/(\alpha*\Delta T)$ as 3.34 mm/(125*$10^{-6}$/K*180 K), consequently 148.44 mm. A PTFE compensating bush that expands when ΔT=180 K by 3.34 mm must consequently have a height $H_K$ of 148.44 mm. If the PTFE compensating bushes are arranged at both ends of the annular stack, the height is halved to 74.22 mm.

Examples 3 to 8

To demonstrate the greater resistance of the annular stack of the separating device according to the invention to axial pressure, 10 annular discs of sintered silicon carbide (SSiC; 3M™ silicon carbide type F, ESK Ceramics GmbH & Co. KG) are in each case stacked one on top of the other and subjected to progressively increasing pressure in a universal testing machine ZWICK 1474 TestXpert II until one or more of the rings ruptures or the maximum force, i.e. the power limit of the testing machine, of 100 kN is reached.

For Examples Nos. 3 to 6, annular discs with spacers that have a planar contact area, as represented in FIGS. 8*a*-8*g*, are used; in the case of Examples Nos. 3, 4 and 6, instead of the 24 spacers, 16 spacers or 3 spacers, uniformly distributed and in the configuration as shown in FIGS. 8*a*-8*g* are respectively provided on the annular discs (see Table 1). For Examples Nos. 7 and 8, annular discs with spacers in the form of spherical segments are used. The results are shown in Table 1.

TABLE 1

| Example No. | Outside diameter of the annular discs [mm] | Number of spacers | Type of spacers | Testing force [kN] | Result |
|---|---|---|---|---|---|
| 3 | 103 | 16 | with planar contact area | 80 | rupturing |
| 4 | 103 | 3 | with planar contact area | 73 | rupturing |
| 5 | 170 | 24 | with planar contact area | >100 | no rupturing* |
| 6 | 170 | 3 | with planar contact area | 96 | rupturing |
| 7 | 103 | 3 | in the form of spherical segments | 6.5 | rupturing |
| 8 | 170 | 3 | in the form of spherical segments | 3.3 | rupturing |

*The maximum force of the testing machine is not enough to crush the rings.

The test results show that annular discs of silicon carbide with spacers that have a planar contact area, such as are used in the separating device according to the invention, withstand an axial force at least 10 times greater than those with spacers in the form of spherical segments.

Examples 9 to 14: Test for Internal and External Pressure Resistance

In a high-pressure chamber, tests for internal pressure resistance (burst pressure test), i.e. subjecting the separating device to internal pressure, and tests for external pressure resistance (collapse pressure test), i.e. subjecting the separating device to external pressure, are carried out with a separating device according to the invention and with reference separating devices. The test setup and the procedure correspond to the setup and method shown in ISO 17824, First Edition, 2009 Aug. 15, in Annex A (Collapse pressure test) and B (Burst pressure test).

The high-pressure chamber has an inside diameter of 80 mm and a usable length of 500 mm. The liquid pressure is applied by a pneumatically driven piston pump (type GRACO X-treme 70, made by Graco Inc., Russell J. Gray Technical Center, 88-11th Avenue Northeast, Minneapolis, Minn. 55413, U.S.A.), which reaches 500 bar (corresponding to 50 MPa or 7250 psi).

A viscous mixture of methylcellulose, water and powdered limestone of various particle sizes in accordance with ISO 17824 Annex A.4 is used as the pressure transmission medium (fluid loss control pill). The task of the pressure transmission medium is to block and seal off the separating gaps (filter gaps) in such a way that a difference in pressure can be built up.

In the case of Examples Nos. 9 to 14, the outside diameter of the annular discs of the separating devices used is 58 mm, the inside diameter is 42 mm and the usable length is 350 mm. The usable length corresponds to the height of the annular stack. The filter width is 250 μm. The material of the annular discs is a single-phase sintered silicon carbide with a density >3.10 g/cm$^3$ (SSiC; 3M™ silicon carbide type F, made by: ESK Ceramics GmbH & Co. KG). The basepipe of the separating device is produced from steel 1.4571. The outside diameter of the basepipe is 38 mm.

Examples Nos. 9 and 12 are according to the invention, Examples Nos. 10 and 11 and also 13 and 14 are reference examples.

For Examples Nos. 9 and 12, according to the invention, a separating device according to FIGS. 5*a*-5*b* is used. The configuration of the annular discs corresponds to FIGS. 8*a*-8*g*, but instead of the 24 spacers shown there the annular disc here has only 8 uniformly distributed spacers. The annular discs have no grooves or clearances on the inner and outer circumferential surfaces. The annular stack is not axially braced on both sides by compression springs, but is fastened on both sides on the basepipe by an end cap in each case. The pre-loading in the annular stack in the axial direction is 2 MPa, with respect to the axially projected surface of the annular discs. On the lateral surface of the basepipe, three spring steel bands are fastened axially parallel and spaced apart from one another by 120° in each case, for centring the annular stack on the basepipe (see FIG. 11). According to FIGS. 5*a*-5*b*, on both sides of the annular stack there is a sealing bush respectively between the end cap and the annular stack. The sealing bushes are made of steel.

For Reference Examples Nos. 10 and 13, a separating device in which the annular discs are provided with 3 spacers in the form of spherical segments according to FIG. 2 of WO2011/120539 A1 is used. On the inner circumferential surface of the annular discs there are 3 grooves, distributed uniformly over the circular circumference. The annular stack is axially braced on both sides by compression springs and is fastened on both sides on the basepipe by an end cap in each case.

For Reference Examples Nos. 11 and 14, a separating device in which the annular discs are provided with 3 spacers in the form of spherical segments according to FIG. 2 of WO2011/120539 A1 is used. On the inner circumferential surface of the annular discs there are 3 grooves, distributed uniformly over the circular circumference. The annular stack is not braced by compression springs, but is fixed on both sides by an end cap in each case. On both sides of the annular stack there is a sealing bush of steel, as shown in FIG. 5, respectively between the annular stack and the end caps.

The results of the tests for the internal pressure resistance are shown by Table 2, the results of the tests for the external pressure resistance are shown by Table 3.

TABLE 2

Results of the tests for the internal pressure resistance

| Example No. | Brief description of the separating device tested | Maximum pressure [bar] |
|---|---|---|
| 9 | 8 spacers with a planar contact area on the annular discs,<br>no grooves on the inner and outer circumferential surfaces of the annular discs,<br>no compression springs for bracing the annular stack,<br>fastening of the annular stack on the basepipe with end caps,<br>sealing bushes of steel on both sides of the annular stack,<br>centring with spring strip steel,<br>basepipe of steel 1.4571,<br>shroud | 143 (rupturing) |
| 10 (reference example) | 3 spacers in the form of spherical segments on the annular discs,<br>3 grooves on the inner circumferential surface of the annular discs,<br>compression springs for bracing the annular stack at both ends of the annular stack,<br>basepipe of steel 1.4571,<br>shroud | 19 (rupturing) |
| 11 (reference example) | 3 spacers in the form of spherical segments on the annular discs,<br>3 grooves on the inner circumferential surface of the annular discs,<br>no compression springs for bracing the annular stack,<br>fastening of the annular stack on the basepipe with end caps,<br>sealing bushes of steel on both sides of the annular stack,<br>basepipe of steel 1.4571,<br>shroud | 22 (rupturing) |

Defined as the criterion for failure in the test for internal pressure resistance is the pressure at which the pressure drops abruptly (maximum pressure). Depending on the construction of the separating device, this is caused by rupturing of a ceramic ring or by yielding of the springs, or both, and consequently opening of the filter gap. If the pressure drops abruptly, the separating device allows coarser particles than correspond to the filter width to pass through (loss of sand control).

TABLE 3

Results of the tests for external pressure resistance

| Example No. | Brief description of the separating device tested | Maximum pressure [bar] |
|---|---|---|
| 12 | 8 spacers with a planar contact area on the annular discs,<br>no grooves on the inner and outer circumferential surfaces of the annular discs,<br>no compression springs for bracing the annular stack, fastening of the annular stack on the basepipe with end caps,<br>sealing bushes of steel on both sides of the annular stack,<br>centring with spring strip steel,<br>basepipe of steel 1.4571,<br>shroud | >500<br>(no rupturing) |
| 13<br>(reference example) | 3 spacers in the form of spherical segments on the annular discs,<br>3 grooves on the inner circumferential surface of the annular discs,<br>compression springs for bracing the annular stack at both ends of the annular stack,<br>basepipe of steel 1.4571,<br>shroud | 123<br>(rupturing) |
| 14<br>(reference example) | 3 spacers in the form of spherical segments on the annular discs,<br>3 grooves on the inner circumferential surface of the annular discs,<br>no compression springs for bracing the annular stack, fastening of the annular stack on the basepipe with end caps,<br>sealing bushes of steel on both sides of the annular stack,<br>basepipe of steel 1.4571,<br>shroud | 305<br>(rupturing) |

Defined as the criterion for failure in the test for external pressure resistance is the pressure at which the pressure drops abruptly (maximum pressure). Depending on the construction of the separating device, this is caused by rupturing of a ceramic ring or by yielding of the springs, or both, and consequently opening of the filter. If the pressure drops abruptly, the separating device allows coarser particles than correspond to the filter width to pass through (loss of sand control).

In the case of Example No. 12 according to the invention, the maximum pressure of the testing device was reached without the separating device failing.

The test results show the much greater pressure resistance of the separating device according to the invention in comparison with the configuration with spacers in the form of spherical on the annular discs and in comparison with the bracing of the annular stack with compression springs.

Examples 15 to 19

For further tests, a larger high-pressure chamber, larger than that used for Examples Nos. 9 to 14, is built. The larger high-pressure chamber has an inside diameter of 203 mm (8 inches), a usable length of 1200 mm (4 ft) and can withstand loading up to about 550 bar (55 MPa, 7975 psi).

In this high-pressure chamber, tests for internal pressure resistance (burst pressure test), i.e. subjecting the separating device to internal pressure, and tests for external pressure resistance (collapse pressure test), i.e. subjecting the separating device to external pressure, are carried out with separating devices according to the invention and with reference separating devices. The test setup and the procedure correspond to the setup and method shown in ISO 17824, First Edition, 2009 Aug. 15, in Annex A (Collapse pressure test) and B (Burst pressure test). The tests carried out in this high-pressure chamber are carried out with separating devices of diameters that correspond to the technically relevant diameters.

A viscous mixture of methylcellulose, water and powdered limestone of various particle sizes in accordance with ISO 17824 Annex A.4 is used as the pressure transmission medium (fluid loss control pill). The task of the pressure transmission medium is to block and seal off the filter gaps in such a way that a difference in pressure can be built up.

Various separating devices, in which the outside diameter of the annular discs and of the basepipe is varied (see Table 4) are used for the tests. The separating devices are constructed with a basepipe of steel L80Cr13 and an annular stack of respectively 80 annular discs of sintered silicon-carbide ceramic (SSiC; 3M™ silicon carbide type F, made by: ESK Ceramics GmbH & Co. KG).

The effective length of the separating devices, i.e. the height of the annular stack, is 500 mm. The filter width is 250 μm. The diameter of the basepipes is 59.6 mm (2⅞ inches) in the case of Examples Nos. 15 and 18, is 88.9 mm (3½ inches) in the case of Example No. 16 and is 139.7 mm (5½ inches) in the case of Examples Nos. 17 and 19.

Examples Nos. 15 to 17 are according to the invention, Examples Nos. 18 and 19 are reference examples.

The configuration of the separating device in the case of Examples Nos. 15 to 17 is according to FIGS. 3*a*-3*b*. The annular discs in the case of Example No. 17 have 24 spacers with a planar contact area according to FIGS. 8*a*-8*g*. The configuration of the annular discs in the case of Examples Nos. 15 and 16 corresponds to the configuration shown in FIGS. 8*a*-8*g*, but instead of the 24 spacers shown there here the annular discs have only 16 (Example No. 15) or 18 (Example No. 16) uniformly distributed spacers on the upper side of the annular discs. The separating devices of Examples Nos. 15 to 17 are constructed according to FIGS.

3*a*-3*b* with three spring steel bands for centring the annular stack (according to FIG. 11), a sealing bush respectively at both ends of the annular stack, an end cap respectively at both ends of the annular stack and also with tWOcompensating bushes of PTFE (according to FIGS. 12*a*-12*c*) located between sealing bushes and end caps. The length of the PTFE compensating bushes is 16 mm.

For Examples Nos. 18 and 19 (reference examples), separating devices with annular discs with spacers in the form of spherical segments according to FIG. 2 of WO2011/120539 A1 are used. In the case of these tWOexamples, compression springs for bracing the annular stack are used at both ends of the annular stack.

The results of the tests for the internal pressure resistance and for the external pressure resistance are shown by Table 4.

TABLE 4

Results of the tests for internal and external pressure resistance

| Example No. | Diameter of basepipe [inches] | Outside diameter of the annular discs [mm] | Type of spacers/ number of spacers | Maximum pressure in the test for internal pressure resistance | Maximum pressure in the test for external pressure resistance |
|---|---|---|---|---|---|
| 15 | 2⅞ | 99 | with planar contact area/16 | 120 bar (1740 psi), rupturing of one ring | up to 500 bar (7250 psi) no failure |
| 16 | 3½ | 115 | with planar contact area/18 | 121 bar (1755 psi), rupturing of one ring | up to 500 bar (7250 psi) no failure |
| 17 | 5½ | 170 | with planar contact area/24 | 136 bar (1972 psi), rupturing of one ring | up to 500 bar (7250 psi) no failure |
| 18 (reference example) | 2⅞ | 99 | in the form of spherical segments/3 | 19.5 bar (282 psi), rupturing of a number of rings | 53 bar (782 psi), rupturing of a number of rings |
| 19 (reference example) | 5½ | 170 | in the form of spherical segments/3 | 19.8 bar (287 psi), rupturing of a number of rings | 32 bar (456 psi), rupturing of a number of rings |

Defined as the criterion for failure in the tests for internal and external pressure resistance is the pressure at which the pressure drops abruptly (maximum pressure). Depending on the construction of the separating device, this is caused by rupturing of a ceramic ring or by yielding of the springs, or both, and consequently opening of the filter. If the pressure drops abruptly, the separating device allows coarser particles than correspond to the filter width to pass through (loss of sand control).

In the case of Examples Nos. 15 to 17, according to the invention, in the test for external pressure resistance the maximum pressure of the testing device was reached without the separating device failing.

The test results show the much greater internal and external pressure resistance of the separating device according to the invention in comparison with the configuration with spacers in the form of spherical segments on the annular discs and the bracing of the annular stack with compression springs.

LIST OF DESIGNATIONS

1 perforated pipe/basepipe
2 thread
3 intermediate element
4 shroud
5 end cap
6 end cap
7 annular stack
8 annular disc
9 upper side of the disc 8
10 spacer
11 contact area of the spacers 10
12 underside of the disc 8
13 bevel
14 separating gap
15 centring bands
16 sealing bush
17 sealing bush
18 perforation of the basepipe 1
19 seal/O-ring
20 weld seam
21 outer lateral surface of the basepipe 1
22 compensating element/compensating bush
23 compensating element/compensating bush
24 compensating element/double-wall compensator bush
25 compensating element/double-wall compensator bush
26 filling and venting hole
27 spiral springs
28 annular disc
29 upper side of the disc 28
30 underside of the disc 28
31 annular disc without spacers
32 annular stack
33 measuring reference area

The invention claimed is:

1. Separating device for removing solid particles from liquids, gases, or both, in extraction wells, the separating device comprising a) an annular stack of at least three annular discs made of a brittle-hard material, each annular disc having an upper side and a lower side, the upper side of the annular discs having at least three spacers which are distributed uniformly over the circular circumference of the discs, the spacers having a contact area contacting an adjacent annular disc and the contact area is planar, so that the spacers have planiform contact with the underside of an adjacent annular disc, and the annular discs being stacked and fixed in such a way that between the individual discs there is in each case a separating gap for the removal of solid particles, and the axial projection of the annular discs at the inner and the outer circumference being circular, and the brittle-hard material of the annular discs being selected from the group consisting of oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ and or long- and/or short-fiber-reinforced ceramic materials, b) a perforated pipe having a lateral surface, which is located inside the annular stack and on which the brittle-hard annular discs are stacked, wherein the annular discs have an inside diameter, the inside diameter being at least 0.5 mm and at most 10 mm greater than an outside diameter of the perforated pipe, c) at least three bands, which are provided axially parallel and uniformly spaced apart on the lateral surface of the perforated pipe located inside the annular stack and onto which the annular discs have been pushed, whereby the annular discs are centered on the perforated pipe, and d) an end cap at the upper end and an end cap at the lower end of the annular stack, the end caps being firmly connected to the perforated pipe.

2. Separating device according to claim 1, wherein the upper side of the annular discs is either inwardly or outwardly sloping in the regions between the spacers (10).

3. Separating device according to claim 1, having a disc axis, wherein the lower side of the annular discs is formed at right angles to the disc axis.

4. Separating device according to claim 1, having a disc axis, wherein the upper side and the lower side of the annular discs are free of spacers formed at right angles to the disc axis.

5. Separating device according to claim 1, the separating device withstanding internal pressures of 120 bar in the test for internal pressure resistance in accordance with ISO 17824 and external pressures of 500 bar in the test for external pressure resistance in accordance with ISO 17824.

6. Separating device according to claim 1, wherein each individual spacer has a contact area of from 4 to 60 $mm^2$.

7. Separating device according to claim 6 comprising more than 3 spacers uniformly distributed on the annular disc; wherein the spacers having a distance between them of from 8 to 50 mm.

8. Separating device according to claim 1, the brittle-hard material being sintered silicon carbide or boron carbide.

9. Separating device according to claim 1, the separating device having a shroud for protection from mechanical damage.

10. Separating device according to claim 1, the separating device comprising a sealing bush at the upper end of the annular stack and a sealing bush at the lower end of the annular stack.

11. Separating device according to claim 1, the separating device comprising a compensating bush at the upper end of the annular stack, at the lower end of the annular stack, or at both the upper and lower end of the annular stack, to compensate for a differing thermal change in length of the perforated pipe and of the annular stack.

12. Separating device according to claim 11, the compensating bush consisting of polytetrafluoroethylene.

13. Separating device according to claim 1, the separating device comprising at the upper end of the annular stack, at the lower end of the annular stack, or at both the upper and lower end of the annular stack, a tubular double-walled liquid-filled container having outer walls, the outer walls of which are corrugated in the axial direction, to compensate for a differing thermal change in length of the perforated pipe and of the annular stack.

14. Separating device according to claim 1, wherein the annular discs are produced from zirconium-dioxide ceramic, and the zirconium-dioxide ceramic has a coefficient of thermal expansion in a temperature range of from 10° C. to 200° C. that deviates by at most 10% from the coefficient of thermal expansion of the material of the perforated pipe in the temperature range of from 10° C. to 200° C.

15. Separating device according to claim 1, wherein the annular stack has a pre-loading in the axial direction in a temperature range of from 10° C. to 200° C. of at most 10 MPa-with respect to an axial projection area of the annular discs.

16. Separating device according to claim 1, wherein a displacement of the annular discs along a length of the annular stack is brought about by a difference in liquid pressure during operation of the separating device in a temperature range of 10° C. to 200° C., said displacement being no more than 0.5 per mil in the axial direction, with respect to the length of the annular stack.

17. Separating device for removing solid particles from liquids and/or gases in extraction wells, comprising a) an annular stack of at least three annular discs, the upper side and the underside of every second annular disc in the annular stack having at least three spacers distributed uniformly over the circular circumference of the discs, and the respectively adjacent annular discs having no spacers, and the contact area of the spacers being planar, so that the spacers have planiform contact with the adjacent annular discs, and the annular discs being stacked and fixed in such a way that between the individual discs there is in each case a separating gap for the removal of solid particles, and the axial projection of the annular discs at the inner and the outer circumference being circular, and the brittle-hard material of the annular discs being selected from the group consisting of oxidic and non-oxidic ceramic materials, mixed ceramics of these materials, ceramic materials with the addition of secondary phases, mixed materials with fractions of ceramic or metallic hard materials and with a metallic binding phase, powder-metallurgical materials with hard material phases formed in situ or long- and/or short-fibre-reinforced ceramic materials, b) a perforated pipe, which is located inside the annular stack and on which the brittle-hard annular discs are stacked, c) at least three bands, which are provided axially parallel and uniformly spaced apart on the lateral surface of the perforated pipe located inside the annular stack and onto which the annular discs have been pushed, whereby the annular discs are centered on the perforated pipe, and d) an end cap at the upper end and an end cap at the lower end of the annular stack, the end caps being firmly connected to the perforated pipe.

18. Separating device according to claim 17, wherein the upper side and the lower side of every second annular disc in the annular stack having at least three spacers distributed uniformly over the circular circumference of the discs is either inwardly or outwardly sloping in the regions between the spacers.

* * * * *